US007506525B2

(12) United States Patent
La Belle et al.

(10) Patent No.: US 7,506,525 B2
(45) Date of Patent: Mar. 24, 2009

(54) WASH PLATE FOR AN AUTOMATIC CLOTHES WASHER

(75) Inventors: Kathleen M. La Belle, Lawrence, MI (US); Kurt Werner, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 670 days.

(21) Appl. No.: 11/041,388

(22) Filed: Jan. 24, 2005

(65) Prior Publication Data

US 2006/0162395 A1 Jul. 27, 2006

(51) Int. Cl.
*D06F 13/00* (2006.01)

(52) U.S. Cl. ..... 68/134; 68/3 R; 68/131

(58) Field of Classification Search ..... None
See application file for complete search history.

(56) References Cited

U.S. PATENT DOCUMENTS 3,132,500 A * 5/1964 Bullock ..... 68/17 A
4,193,275 A * 3/1980 Bochan ..... 68/134
5,168,621 A * 12/1992 Kruck et al. ..... 29/451
5,946,949 A * 9/1999 Park et al. ..... 68/53
2003/0200774 A1 * 10/2003 Kim et al. ..... 68/133

FOREIGN PATENT DOCUMENTS

JP 6114189 4/1994
JP 07163778 A * 6/1995

OTHER PUBLICATIONS

Daewoo Electronics Co., Ltd, "Daewoo Air Power Washer", 1996, 4 Pages.

* cited by examiner

*Primary Examiner*—Michael Kornakov
*Assistant Examiner*—Eric Golightly
(74) *Attorney, Agent, or Firm*—Clifton Green; Michael D. Lafrenz

(57) ABSTRACT

An automatic washing machine comprises a wash tub and a wash plate movably mounted within the wash tub for imparting mechanical energy to articles of fabric in the wash tub. The wash plate comprises a base and a blade that extends from the base and terminates in a tip. According to the invention, at least the tip of the blade is formed by an insert. The insert is made from a relatively hard and wear resistant material that is different than the material of the impeller body. As a result, the wear resistance and performance of the impeller is improved without significantly increasing the overall cost of the impeller.

17 Claims, 20 Drawing Sheets

WASH PLATE FOR AN AUTOMATIC CLOTHES WASHER

BACKGROUND OF THE INVENTION

1. Field of the Invention

The invention relates generally to a wash plate for an automatic clothes washer and particularly to a wash plate comprising one or more blades formed at least in part by an insert.

2. Description of the Related Art

Automatic clothes washers, which are also commonly called washing machines, are well known appliances for washing clothing and other fabric items, such as towels, sheets, blankets, and the like. Clothes washers typically comprise a perforated basket located within an imperforate tub, with the basket being rotatable relative to the tub. The clothing is placed in the basket where the wash liquid is free to flow between the basket and the tub through the perforations. Clothes washers are either vertical axis machines, wherein the basket rotates about a generally vertical axis, or horizontal axis machines, wherein the basket rotates about a generally horizontal axis.

Vertical axis clothes washers usually include a wash plate mounted within the basket and moveable relative to the basket about the vertical axis to impart mechanical energy to submerged, partially submerged, or wetted clothes for moving the clothes within the basket. The wash plate can impart the mechanical energy to the clothes by directly contacting the clothes and/or moving the liquid to thereby move the clothes. Examples of such wash plates include an impeller, a nutator, and an agitator, which can be used alone or in combination with an auger. All of these wash plates are well known in the clothes washer art and have a variety of designs and structures. A common feature of most wash plates is a set of blades, fins, or other type of projection or protrusion (hereinafter referred to as blades) that extends from a base for imparting the mechanical energy to the clothes or wash fluid.

It is common in the industry for the entire wash plate, including the blades, to be constructed as a unitary piece made from a cost-effective polymer having a relatively low hardness, such as polypropylene. Because the polymer has a relatively low hardness, contact between the blades and the clothes tends to wear the blades over time. If the wear on the blades, which depends also on the types of clothes in the basket, is sufficient to change the shape and/or size of the blades, then the cleaning performance of the clothes washer can deteriorate. The wearing can also roughen the blade surface, which can undesirably increase the wear on the clothing being washed.

One solution to this problem is to replace the wash plate when the blades wear a predetermined amount; however, it is expensive and inconvenient to purchase and install an entire wash plate. Another solution is to make the wash plate, including the blades, from stainless steel, which is significantly harder than polypropylene and similar polymers and has an appearance generally associated with high end or premium goods. Nonetheless, stainless steel is considerably more expensive than polypropylene and similar polymers and, therefore, a wash plate made entirely of stainless steel undesirably increases the overall cost of the clothes washer.

A similar problem exists in horizontal axis clothes washer where the basket includes a set of circumferentially spaced blades that extend parallel to the longitudinal axis of the basket and along the interior of the basket. As the basket rotates, the blades impart mechanical energy to the clothes to tumble the clothes within the basket. As with the wash plates described above, the basket and the blades are usually made of a polymer with a relatively low hardness, such as polypropylene, and the blades tend to wear over time due to the contact between the blades and the clothes. However, a basket, including the blades, constructed of wear-resistant stainless steel is very expensive and reserved for high end clothes washers.

It is therefore desirable for the blades of a clothes washer wash plate and a clothes washer horizontal basket to be wear resistant, easy to replace, and aesthetically appealing without significantly increasing the overall cost of the wash plate and basket, respectively.

SUMMARY OF THE INVENTION

An automatic clothes washer according to the invention for washing articles of fabric comprises a wash tub defining a wash chamber for receiving the articles of fabric and a wash plate movably mounted within the wash tub for imparting mechanical energy to the articles of fabric. The wash plate comprises a base, and a blade extending from the base and terminating in a tip, wherein at least the tip of the blade is formed by an insert mounted to the wash plate.

The insert is preferably made from a material having a hardness greater than the base. For example, the insert can be made of metal, such as stainless steel.

The insert can be snap fit onto one of the base and the blade. The insert can be slidably mounted to one of the base and the blade. The insert can be integrally molded with one of the base and the blade. The blade can be made of the same material as the base. The blade can be plastic, and the insert can be metal.

The insert can comprise the entire blade. The blade can comprise opposing side walls that extend upward from the base and incline toward one another until they terminate at the tip. The tip can comprise a generally horizontal upper surface that spans between the opposing side walls. The opposing side walls of the blade and the base can effectively form a generally continuous surface at the juncture thereof.

Optionally, the insert can be a different color than the base. The wash plate can be one of an agitator, an impeller, and a nutator.

In another aspect, the invention relates to a wash plate according to the invention for an automatic clothes washer comprises a base and a blade extending from the base and terminating in a tip, wherein at least the tip of the blade is formed by an insert.

DESCRIPTION OF THE PREFERRED EMBODIMENT

Figure 1:
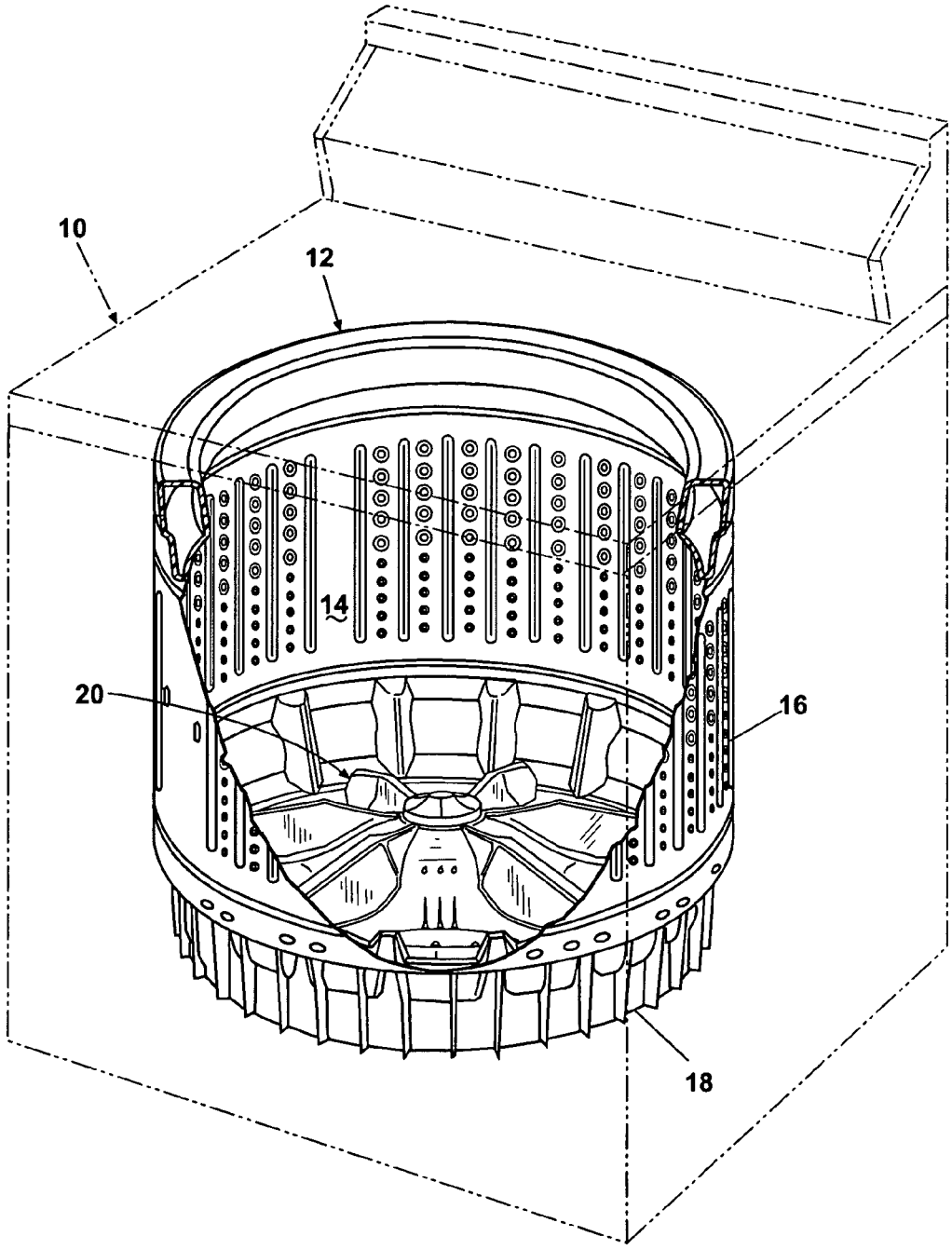
FIG. 1 is a perspective view of a wash basket of a vertical axis automatic clothes washer and an impeller having a base and blades formed by an insert according to the invention.

Referring now to the figures and particularly to FIG. 1, a conventional vertical axis automatic clothes washer 10 comprises an open top wash basket 12 that defines a wash chamber 14 sized to receive a fabric load. The wash basket 12 includes a bottom wall 18 and a perforated side wall 16 and is rotatable about a vertical axis. As is common with conventional clothes washers but not shown in FIG. 1 for clarity, an imperforate wash tub houses the wash basket 12, a preferably reversible drive mechanism rotates the wash basket 12 relative to the wash tub, and a liquid circulation system fills the wash tub and thereby the wash basket 12 with a predetermined amount of liquid to at least partially submerge the fabric load. The clothes washer 10 further comprises a wash plate in the form of an impeller 20 mounted within the wash basket 12 and coupled to the drive mechanism such that the impeller 20 can rotate relative to the wash basket 12 and the wash tub. Rotation of the wash basket 12 and the impeller 20 imparts mechanical energy to the liquid and to the fabric load to move the fabric load within the wash chamber.

Figure 2:
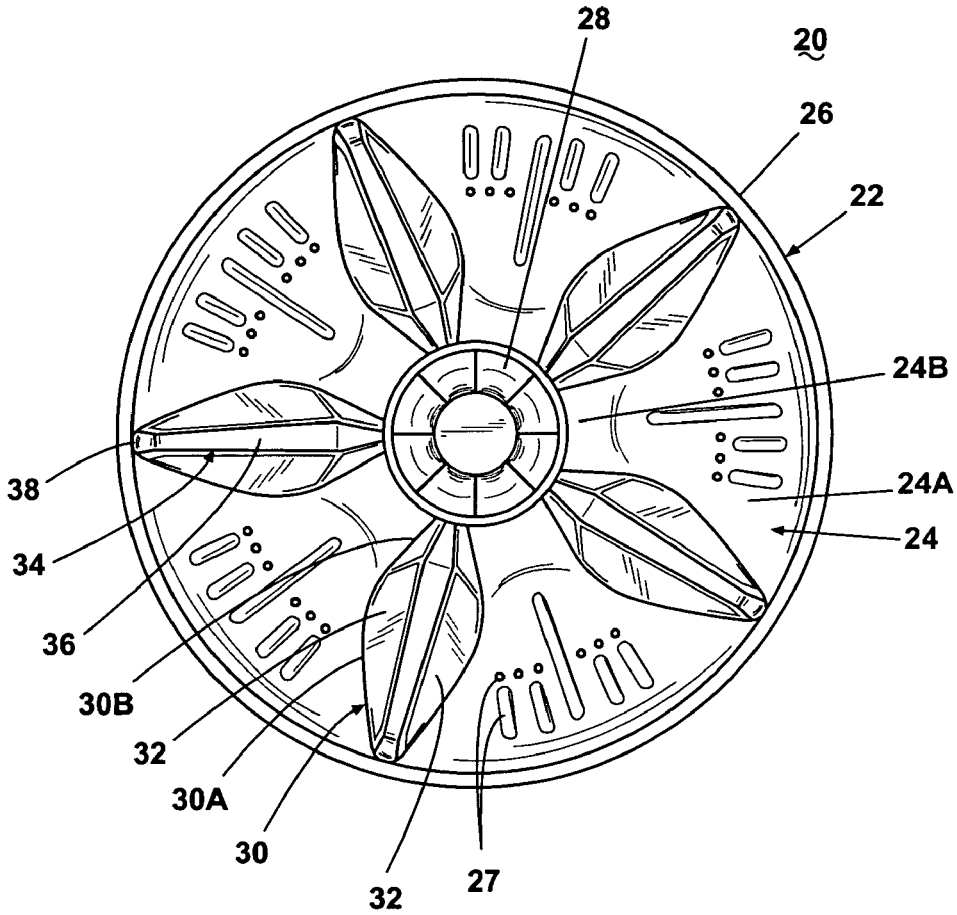
FIG. 2 is a top view of the impeller of FIG. 1.
Figure 3:
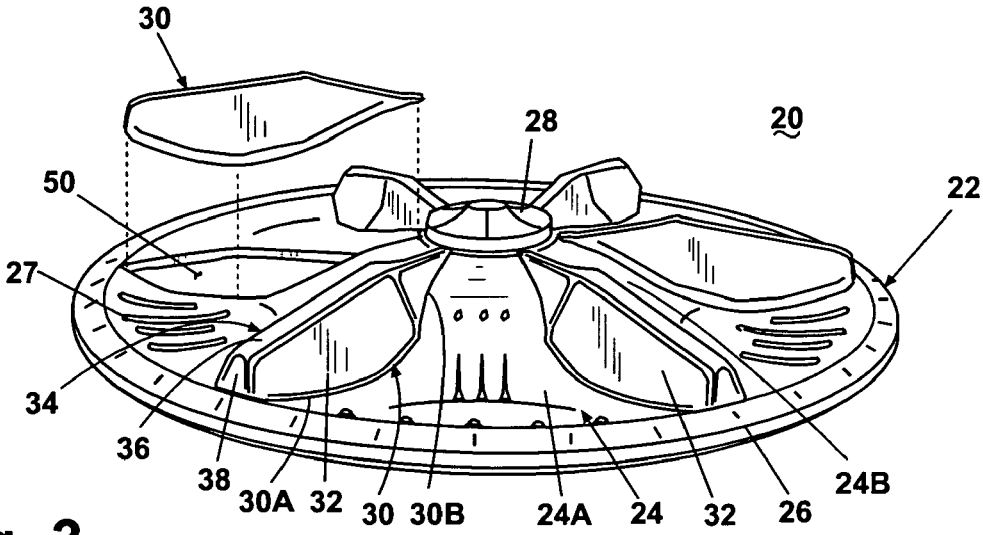
FIG. 3 is a perspective view of the impeller of FIG. 1 with the insert mounted to an opening in the base from above the impeller.

Referring additionally to FIGS. 2 and 3, the impeller 20 comprises a generally circular base 22 with an annular region 24 that extends radially between a round peripheral edge 26 and a center cap 28. The connection between the impeller 20 and the drive mechanism is located beneath the center cap 28. The annular region 24 has a radially outward section 24A that slopes downward from the peripheral edge 26 and merges into a radially inward section 24B that slopes upward to the center cap 28. Optionally, the base 22 includes a plurality of apertures 27 formed in the annular region 24 so that the liquid in the wash chamber 14 can flow therethrough. The base 22 is made of a first, relatively inexpensive material, which is preferably a polymeric material, such as polypropylene.

The impeller 20 further comprises a plurality of circumferentially spaced radial blades 30 that project upward from the annular region 24 of the base 22 and extend from the center cap 28 toward the peripheral edge 26. Each blade 30 has a radially outward portion 30A corresponding to the radially outward portion 24A of the annular region 24 and a radially inward portion 30B corresponding to the radially inward portion 24B of the annular region 24. Each blade 30 is formed by a pair of opposing side walls 32 that incline toward one another and terminate at a tip 34. The tip 34 has a generally flat and elongated upper surface 36 and a generally flat terminal surface 38 depending from the upper surface 36 and located near the peripheral edge 26. During use of the clothes washer 10, the blades 30 impart mechanical energy to the clothes by direct contact therewith and/or indirectly through the liquid as the impeller 20 rotates within the wash chamber 14.

According to the invention, the blades 30 are formed by an insert that is separate from the body 22. The insert can form the entire blade 30, as shown in FIGS. 1-3, or portions thereof, as will be described in more detail hereinafter. The blades 30 are made of a second material different from the first material of the body 22. The second material is preferably harder and more wear resistant than the first material to avoid undesirable wear of the blades 30 that can result from repeated contact with the fabric load. Additionally, the second material can improve the aesthetic qualities of the blade 30 to, for example, give the impeller 20 a high-end appearance or an appearance that a user associates with cleanliness or and superior quality. Preferably, the second material is a metal, such as stainless steel, which has excellent wear resistance, is frequently associated with high end appliances, and can withstand the wet environment of the wash chamber 14. Optionally, the second material can be a polymer with a greater wear resistance than the first material of the body 22. Further, the polymer can be a different color than the first material to appeal to a consumer's senses. For example, research has shown that consumers associate certain colors with cleanliness, and consumers in the United States associate blues and whites with blue tones therein with cleanliness. Alternatively, the consumer can optionally select the color of the second material for personal reasons, such as to match the decor in the consumer's home or the colors of a favorite sports team.

When mounted to the impeller 20, the insert preferably forms a generally continuous surface at a juncture between the insert and the body 22 or other part of the impeller 20 to which the insert is attached. Preferably, only a linear seam, as compared to steps or ridges, delineating the insert from the impeller 20 along the edges of the insert is visible to the user. This smooth transition also prevents fabric items in the fabric load from catching onto the insert or the part of the impeller 20 to which the insert is mounted at the juncture therebetween. In the embodiment shown in FIGS. 1-3, the side walls 32 of the blade 30 and the terminal surface 38 of the tip 34 meet the body 22 at the annular region 24 and the peripheral edge 26, respectively, and are shaped so that the edges of the insert effectively blend therewith in the same manner as an impeller constructed of a unitary piece. The extent to which the insert and the impeller 20 form a continuous surface depends on the shape of the insert and the manner in which the insert is mounted to the impeller 20.

Figure 4:
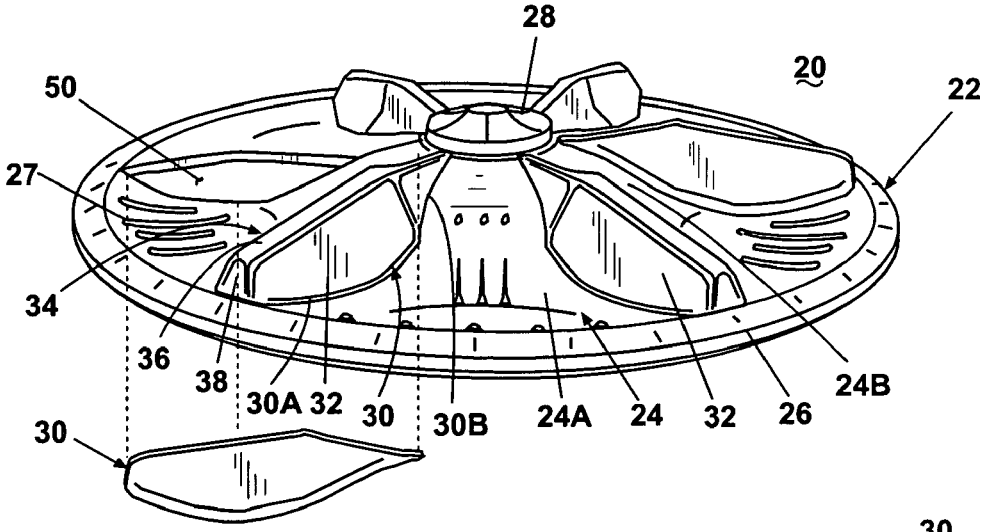
FIG. 4 is a perspective view similar to FIG. 3 with the insert mounted to the opening from below the impeller.
Figure 5:
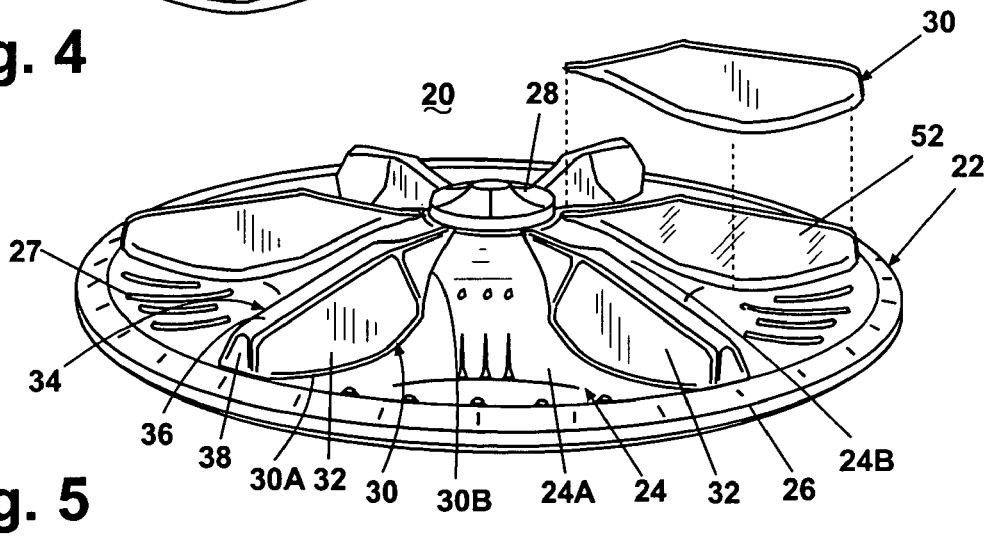
FIG. 5 is a perspective view similar to FIG. 3 with the insert mounted over a supporting surface on the base.

The insert can be mounted to the impeller 20 in any suitable fashion. The insert can be removably mounted to the impeller 20, permanently mounted to the impeller 20, or formed integrally with the impeller 20, such as by integrally molding the insert and the impeller 20. Referring to FIGS. 3-5, the insert can be mounted to an opening 50 in the base 22 from above the impeller 20 (FIG. 3), mounted to the opening 50 in the base 22 from below the impeller 20 (FIG. 4), and mounted on a supporting surface 52 on the base 22. Further, the insert can be mounted to the impeller 20 by mechanically fastening the insert to the impeller 20; otherwise mechanically coupling the insert to the impeller 20, such as by sliding the insert onto the impeller 20 or snap-fitting the insert into the impeller 20; using an adhesive to attach the insert to the impeller 20; employing a suitable chemical joining process; heat staking; or sonic welding. Examples of mounting methods and structures are shown in FIGS. 6-13.

Figure 6:
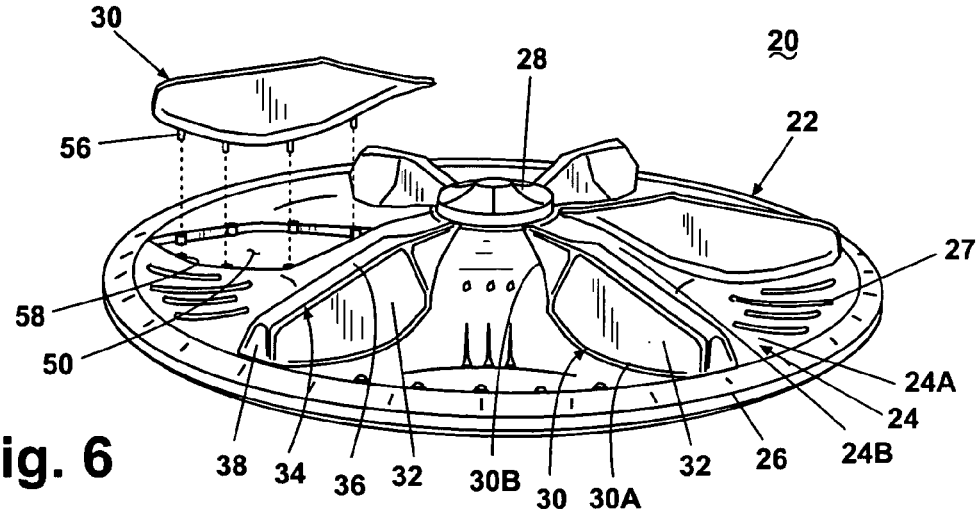
FIG. 6 is a perspective view similar to FIG. 3 with the insert mounted to the opening with mechanical fasteners in the form of mating pins and pin receivers.
Figure 7:
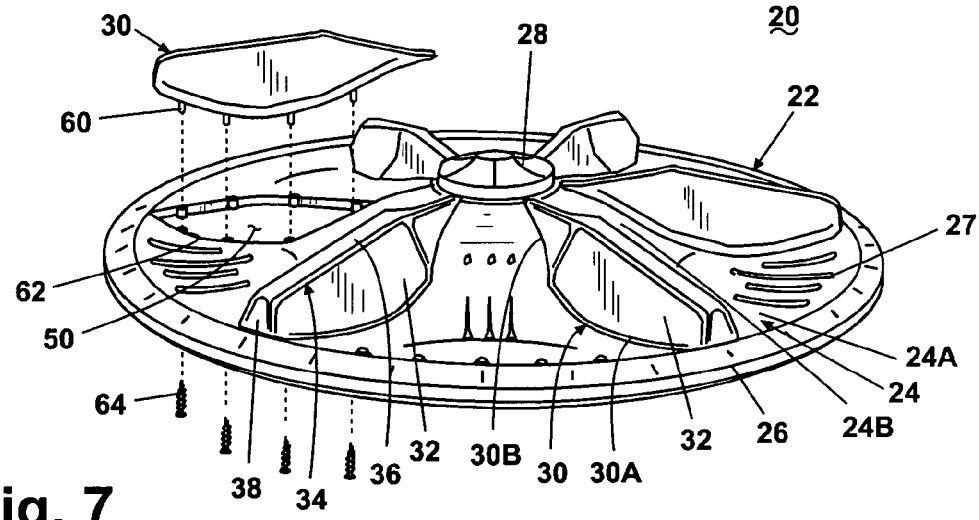
FIG. 7 is a perspective view similar to FIG. 3, wherein the mechanical fasteners are in the form of screws.
Figure 8:
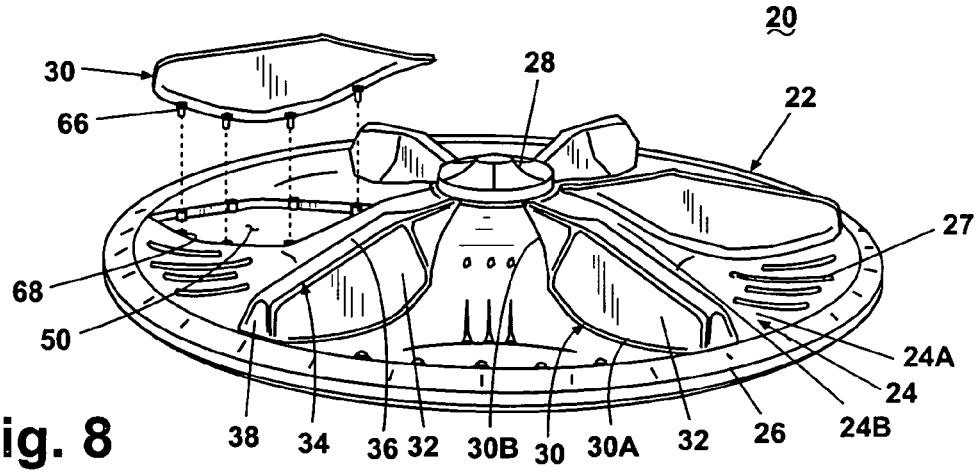
FIG. 8 is a perspective view similar to FIG. 7, wherein the mechanical fasteners are in the form of rivets.

FIGS. 6-8 depict exemplary methods of mechanically fastening the insert to the body 22. In FIG. 6, the insert comprises a plurality of pins 56 extending downward therefrom, and the body 22 of the impeller 20 includes a plurality of corresponding pin receivers 58 aligned along the opening 50. The pin receivers 58 are shaped and sized to securely hold the pins 56 in a manner to prevent inadvertent removal of the insert. The insert of FIG. 7 comprises a plurality of internally threaded screw receivers 60 extending downward therefrom, and the body 22 includes a plurality of screw bosses 62 arranged along the opening 50 and aligned with the screw receivers 60. A plurality of screws 64 inserted from below the impeller 20 and extending through the screw bosses 62 mate with the screw receivers 60 to secure the insert to the impeller 20. In FIG. 8, the insert comprises a plurality of rivets 66 extending downward therefrom, and the body 22 has corresponding rivet receivers 68 along the opening 50. To mount the insert of FIG. 8 to the body 22, the rivets 66 are inserted into the rivet receivers 68 such that the ends of the rivets 66 protrude beyond the rivet receivers 68 so that they can be hammered or otherwise deformed to securely fasten the insert to the impeller 20.

Figure 9A:
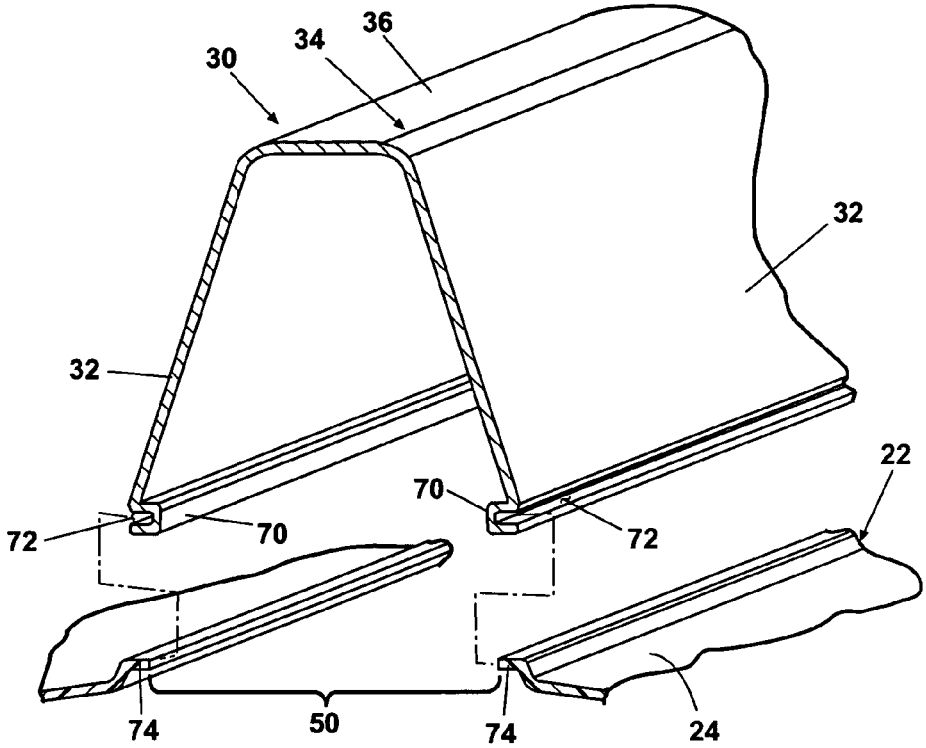
FIG. 9A is a schematic, exploded isometric view of an exemplary insert and the base of the impeller of FIG. 1, wherein the insert has grooves that slidingly receive projections on the base.
Figure 9B:
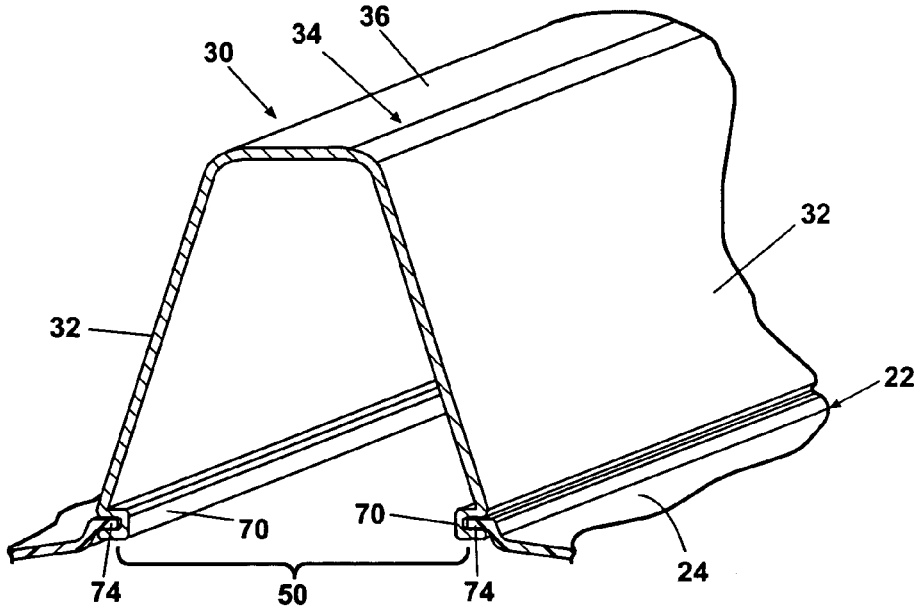
FIG. 9B is a schematic isometric view of FIG. 9A.
Figure 10A:
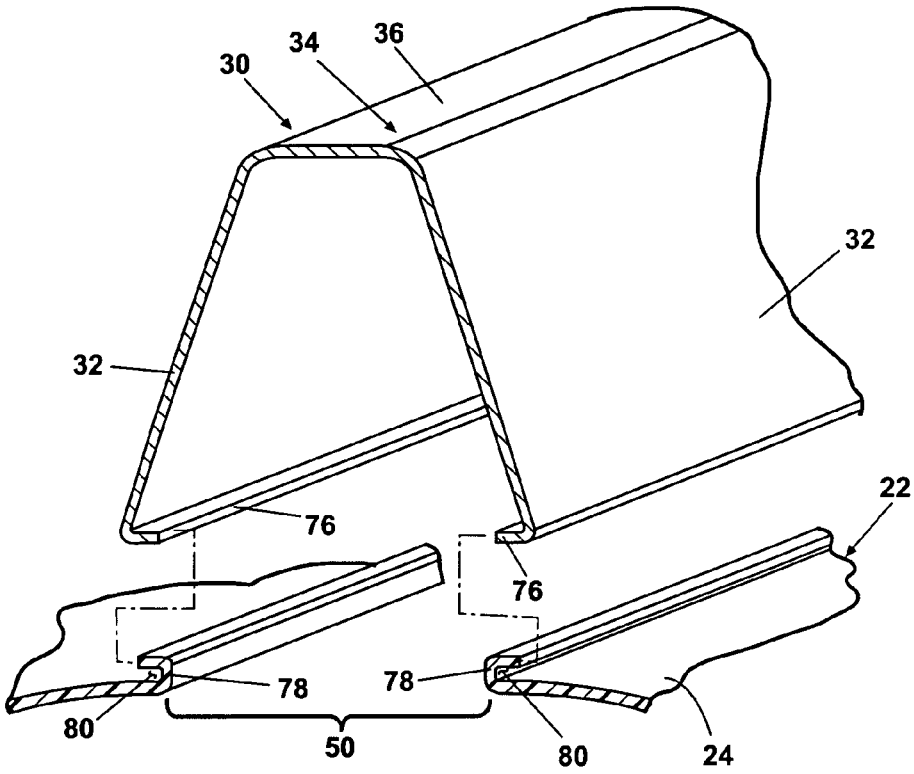
FIG. 10A is a schematic, exploded isometric view of an exemplary insert and the base of the impeller of FIG. 1, wherein the base has grooves that slidingly receive projections on the insert.
Figure 10B:
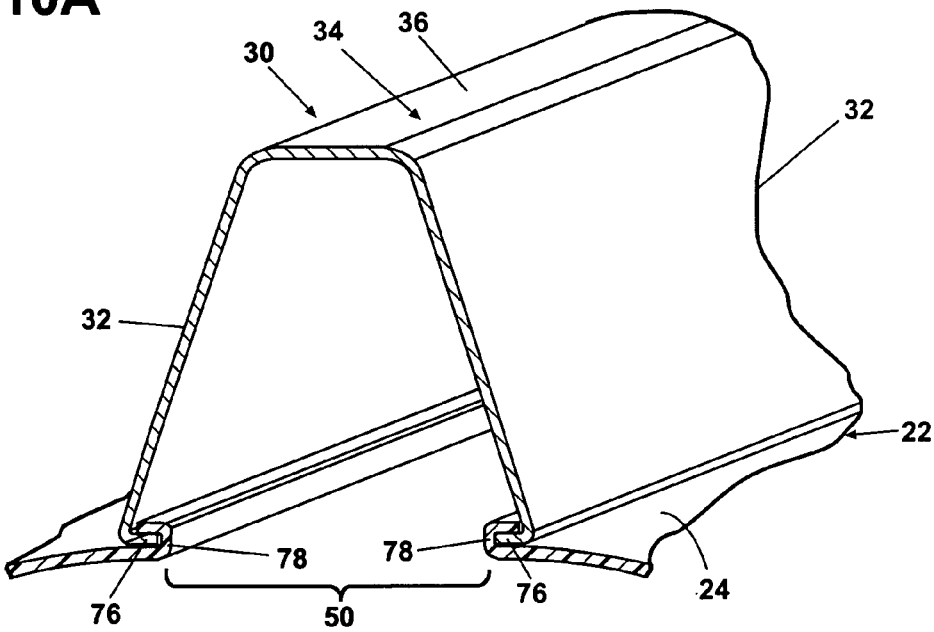
FIG. 10B is a schematic isometric view of FIG. 10A.

Depending on the shape of the insert, the insert can be slidably mounted to the body 22. Preferably, the insert and the body 22 comprise mating projections and grooves, wherein the projections are slidably received by the grooves. Examples of such structures are schematically shown in FIGS. 9A-10B. In FIGS. 9A and 9B, the insert comprises a pair of elongated and inward C-shaped flanges 70 that extend along the edges of the opposing side walls 32 and form outwardly facing grooves 72. The edges of the body 22 along the opening 50 function as elongated projections 74 sized for receipt within the grooves 72. The insert of FIGS. 10A and 10B comprises a pair of inward, opposing projections 76 along the edges thereof, and the body 22 has a pair of upward L-shaped flanges 78 that extend along the edges of the opening 50 and form outwardly facing grooves 80. To mount the inserts of FIGS. 9A-10B to the corresponding body 22, the projections 74, 76 are aligned with the grooves 72, 80, respectively, and the insert is slid onto to the body 22.

The structures of FIGS. 9A-10B can also be utilized to snap fit the insert to the body 22 if the second material is a resilient material or a sufficiently elastic material. For example, the opposing side walls 32 of the insert in FIGS. 9A and 9B can be deflected toward one another so that the flanges 70 of the insert, positioned directly over the opening 50, can fit through the opening 50 to align the grooves 72 with the projections 74. Once the insert is aligned properly, the opposing side walls 32 are released so that they return to their original orientation while the projections 74 enter the grooves 72.

Figure 11A:
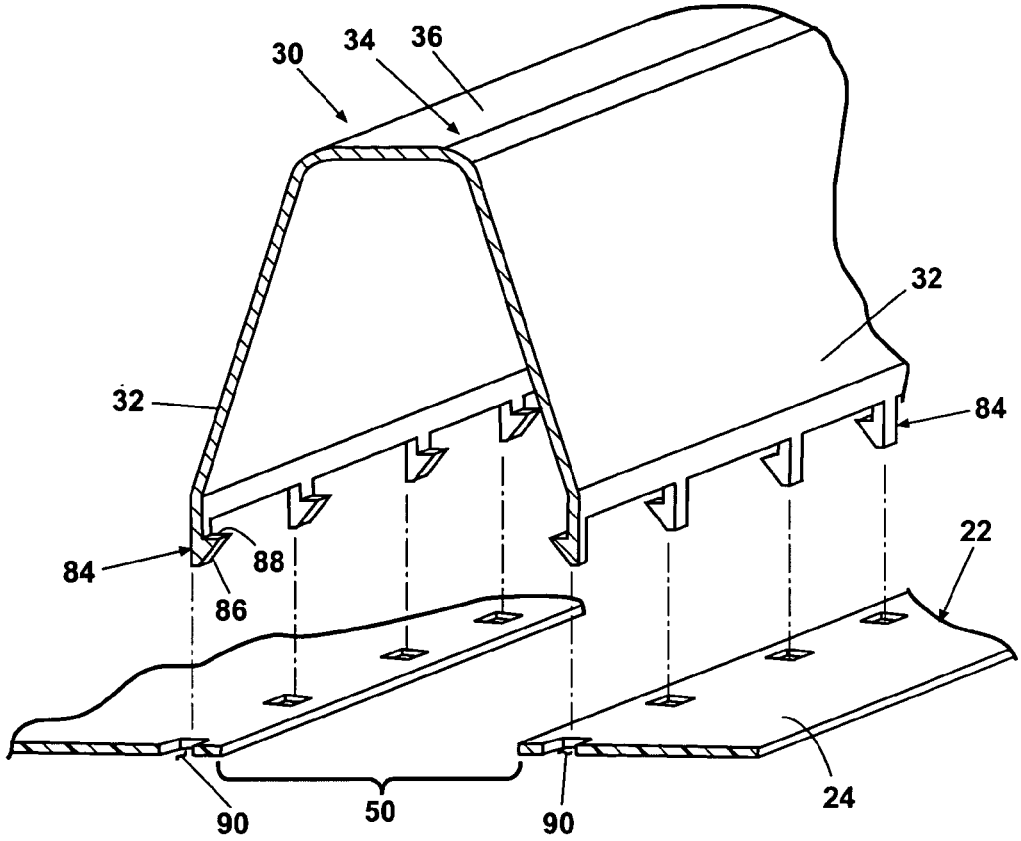
FIG. 11A is a schematic, exploded isometric view of an exemplary insert and the base of the impeller of FIG. 1, wherein the insert has a plurality of prongs that snap fit into openings on the base.
Figure 11B:
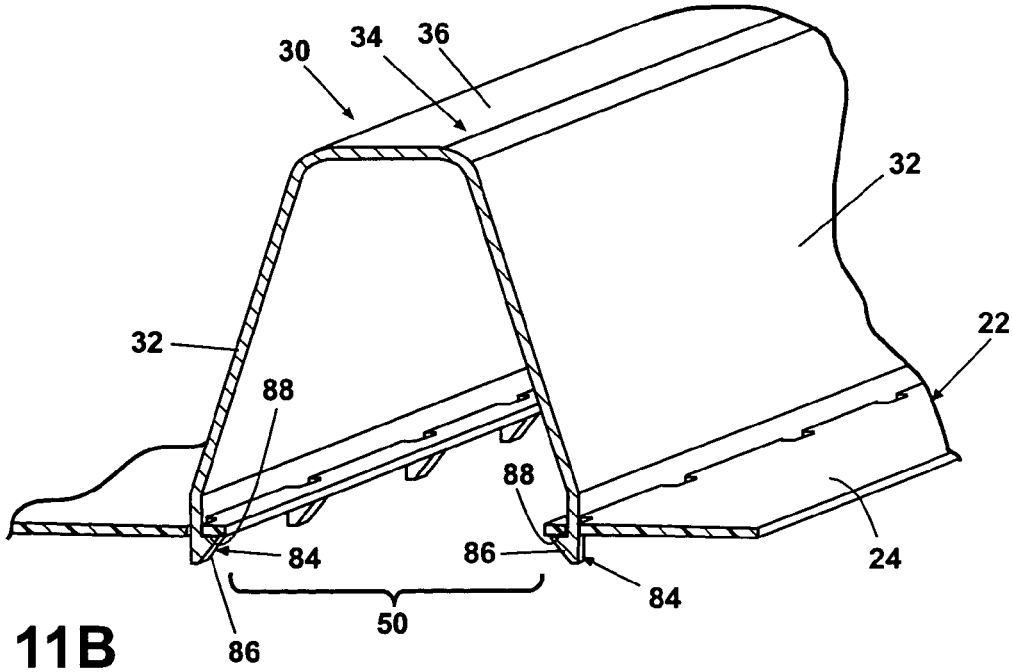
FIG. 11B is a schematic isometric view of FIG. 11A.

Other examples of inserts that can be snap fit into the body 22 are schematically shown in FIGS. 11A-12B. The inserts in these examples comprise resilient prongs that mate with the opening 50 or with other openings formed in either the insert or the body 22. In FIGS. 11A and 11B, a plurality of inwardly projecting opposing prongs 84 formed along the edges of the opposing side walls 32 of the insert mate with a plurality of openings 90 in the body 22. Each of the opposing prongs 84 includes an angled face 86 and a retaining face 88 to facilitate mounting the insert to the body 22. Alternatively, the opposing prongs 84 can be continuous along the edges of the opposing side walls 32, in which case the openings 90 are also continuous to correspond with the opposing prongs 84. To mount the insert to the body 22, the insert is positioned above the body 22 with the opposing prongs 84 aligned with the openings 90. The opposing side walls 32 are spaced so that the angled faces 86 of the opposing prongs 84 align with the inside edge of the openings 90. As a result, when the insert is lowered into contact with the body 22, the angled faces 86 ride along the inside edges of the openings 90 to thereby flex the opposing prongs 84 outward until the angled faces 86 clear the body 22, at which point, the opposing prongs 84 snap inward toward the inward edges of the openings 90 so that the retaining face 88 abuts the lower surface of body 22 to prevent upward movement of the insert relative to the body 22.

Figure 12A:
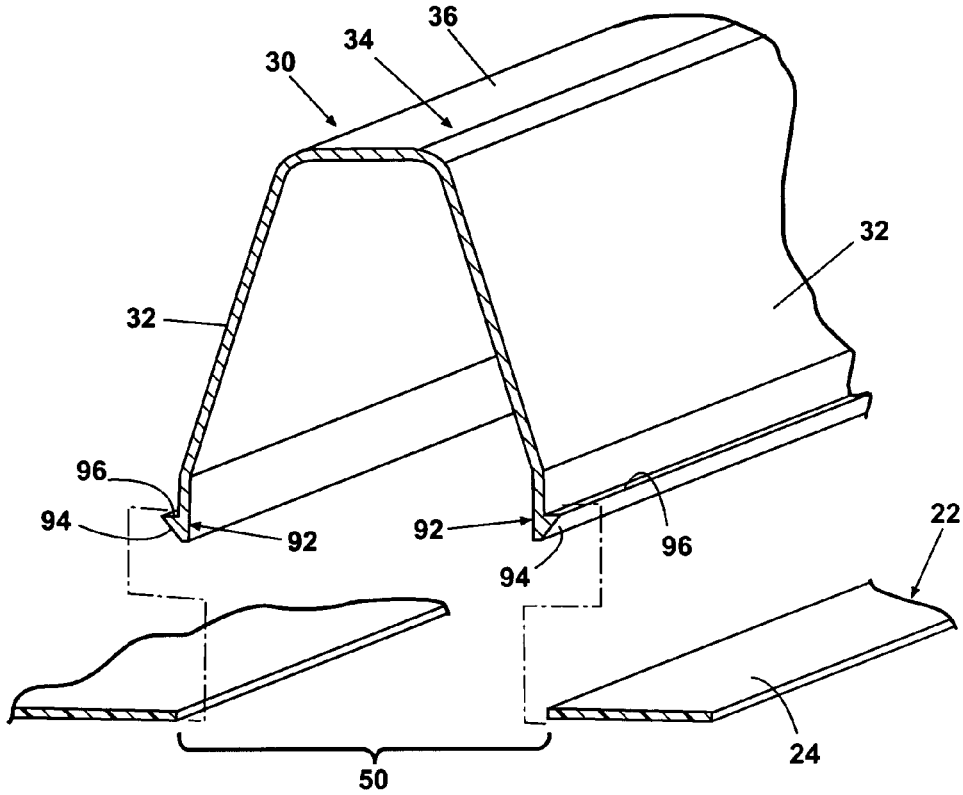
FIG. 12A is a schematic, exploded isometric view of an exemplary insert and the base of the impeller of FIG. 1, wherein the insert has a pair of opposing, elongated prongs that snap fit into an opening on the base.
Figure 12B:
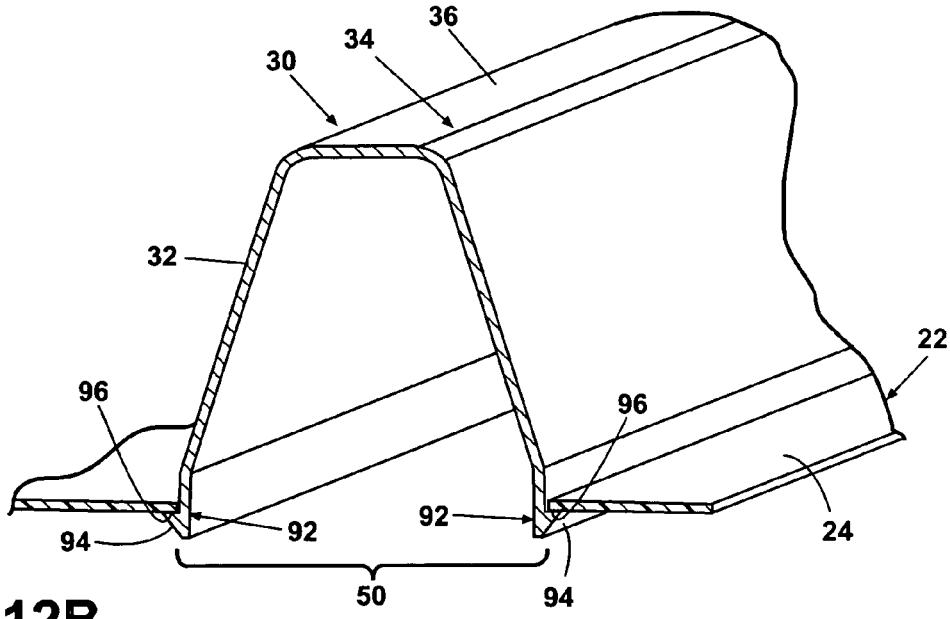
FIG. 12B is a schematic isometric view of FIG. 12A.

In FIGS. 12A and 12B, the insert comprises a pair of outwardly projecting opposing prongs 92 extending along the edges of the opposing side walls 32. Each of the opposing prongs 92 includes an angled face 94 and a retaining face 96 to facilitate mounting the insert to the body 22. Alternatively, the opposing prongs 92 can be in the form of a plurality of opposing prongs, much like the opposing prongs 84 shown in FIGS. 11A and 11B. To mount the insert to the body 22, the insert is positioned above the body 22 with the opposing prongs 92 aligned with the edges of the opening 50. The opposing side walls 32 are spaced so that the angled faces 94 of the opposing prongs 92 align with the edges of the opening 50. As a result, when the insert is lowered into contact with the body 22, the angled faces 94 ride along the edges of the opening 50 to thereby flex the opposing prongs 92 inward until the angled faces 94 clear the body 22, at which point, the opposing prongs 92 snap outward toward the edges of the opening 50 so that the retaining face 96 abuts the lower surface of body 22 to prevent upward movement of the insert relative to the body 22.

Figure 13:
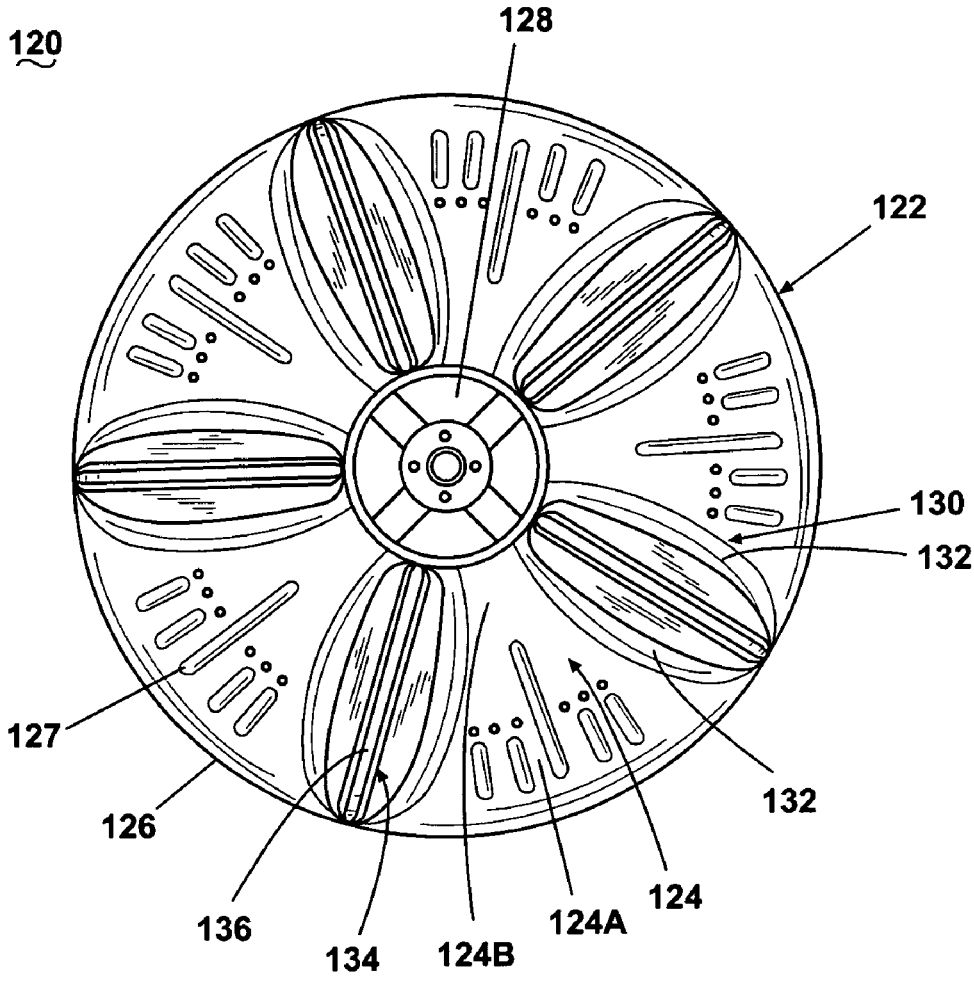
FIG. 13 is a top view of an alternative impeller having a base and blades with a portion thereof formed by an insert according to the invention.

As stated above, the insert can form the entire blade 30 or portions thereof. An alternative impeller 120 comprising a base 122 and blades 130, wherein each blade has opposing side walls 132 and a tip 134, is illustrated in FIG. 13. In this embodiment, an insert forms the tip 134 and a portion of the opposing side walls 132 rather than the entire blade 130, as shown in the previous embodiment of FIGS. 1-12B. The insert can be mounted to the portions of the opposing side walls 132 that are not part of the insert in any suitable fashion, including the methods and structures shown and described above with respect to the previous embodiment.

Figure 14:
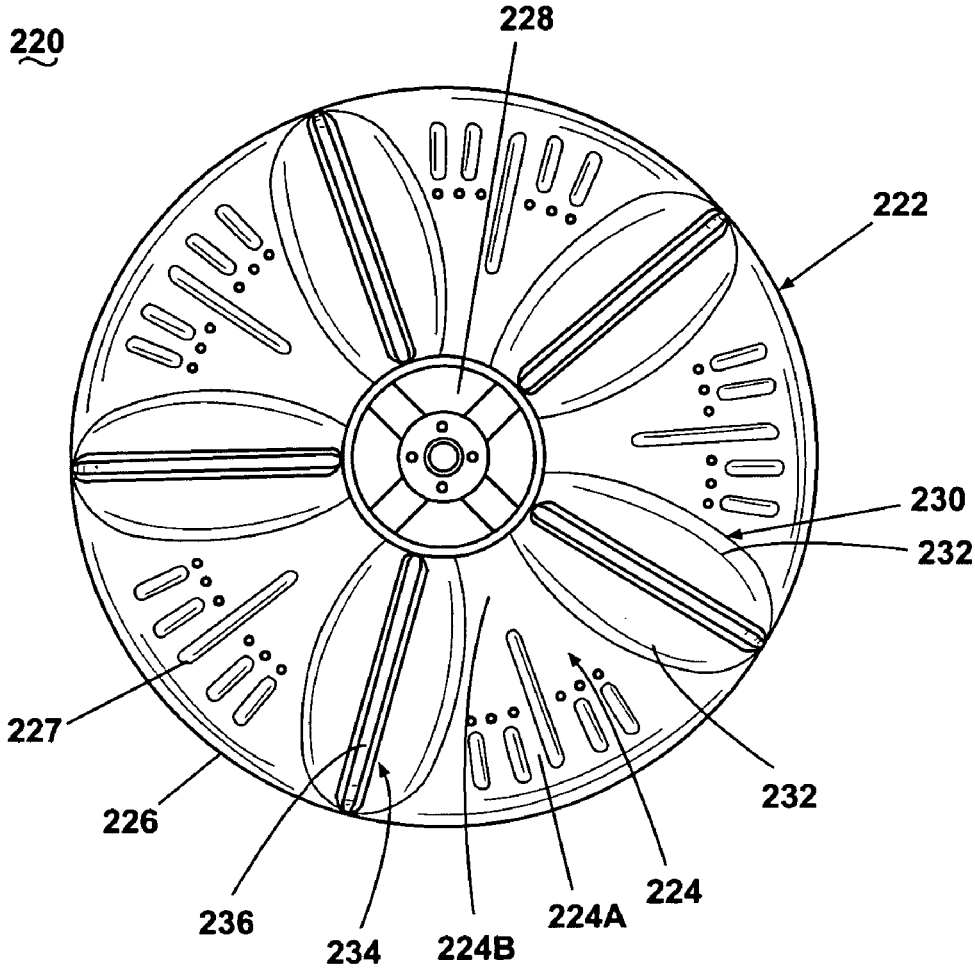
FIG. 14 is a top view of an alternative impeller similar to the impeller of FIG. 13 having a base and blades with a tip formed by a tip insert according to the invention.

Referring now to FIG. 14, another alternative impeller 220 having a design identical to that of the impeller 120 of FIG. 13 comprises a base 222 and blades 230 with opposing side walls 232 and a tip 234, wherein the tip 234 is formed by a tip insert. As with the embodiment of FIG. 13, the tip insert can be mounted to the opposing side walls 232 in any suitable fashion, including the methods and structures shown and described above with respect to the embodiment of FIGS. 1-12B. Examples of mounting a tip insert are described in detail below.

Figure 15:
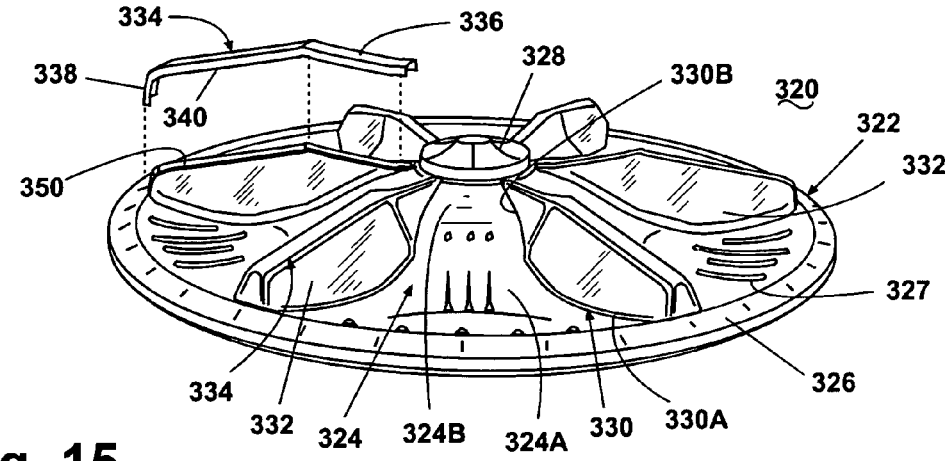
FIG. 15 is a perspective view of an alternative impeller having a base and blades with a tip formed by a tip insert according to the invention, wherein the tip insert is mounted to an opening in the blade from above the impeller.
Figure 16:
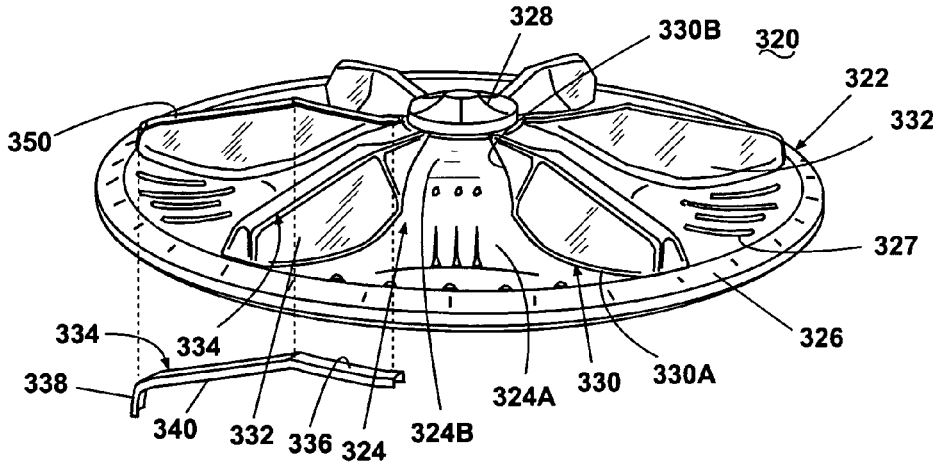
FIG. 16 is a perspective view similar to FIG. 15 with the tip insert mounted to the opening from below the impeller.
Figure 17:
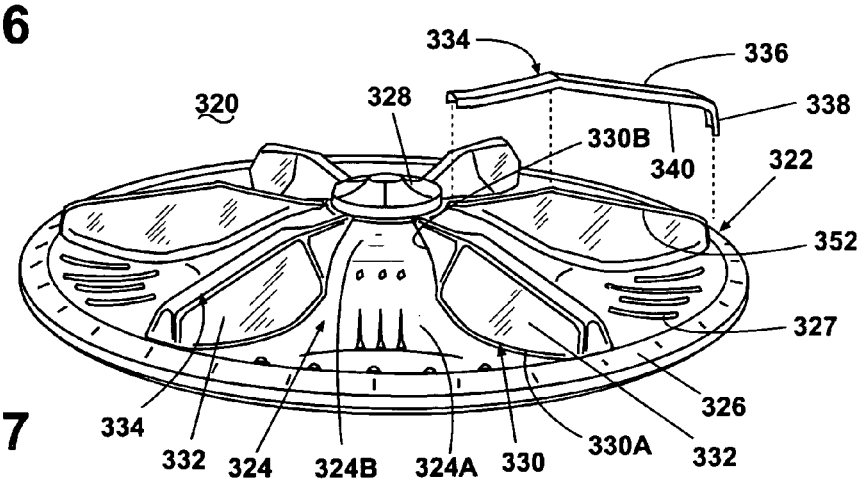
FIG. 17 is a perspective view similar to FIG. 15 with the tip insert mounted over a supporting surface on the blade.

Referring now to FIGS. 15-17, the alternative impeller 320 is substantially identical to the impeller 20 of FIGS. 1-12B, and corresponding components are identified with a reference number having the form 3XX, where the XX is the reference numeral of the corresponding component of the impeller 20. The only difference between the impeller 320 and the impeller 20 is that the insert of the former is a tip insert that forms the tip 334 of the blades 330. As shown in FIGS. 15-17, the tip insert comprises the upper surface 336 and the terminal surface 338 of the tip 334 and includes a pair of opposing side walls 340 that depend from opposite edges of the upper surface 336 and the terminal surface 338. The side walls 340 are optional and can be any suitable height.

As described above with respect to the insert for the impeller 20, the tip insert can be removably mounted to the impeller 320, permanently mounted to the impeller 320, or formed integrally with the impeller 320, such as by integrally molding the tip insert and the impeller 320. When the tip insert is integrally molded with the impeller 20, the opposing side walls 332 of the blade 330 are preferably made of the first material, along with the base 322, while the tip insert is made of the second material. Referring to FIGS. 15-17, the tip insert can be mounted to an opening 350 in the blade 330 from above the impeller 320 (FIG. 15), mounted to the opening 350 in the blade 330 from below the impeller 320 (FIG. 4), and mounted on a supporting surface 352 on the blade 330. Further, the tip insert can be mounted to the blade 330 by mechanically fastening the tip insert to the blade 330; otherwise mechanically coupling the tip insert to the blade 330, such as by sliding the tip insert onto the blade 330 or snap-fitting the tip insert into the blade 330; using an adhesive to attach the tip insert to the blade 330; or employing a suitable chemical joining process, such as heat staking and sonic welding. Examples of structures for slidably mounting and snap fitting the tip insert to the blade 330 are schematically shown in FIGS. 18A-22B.

Figure 18A:
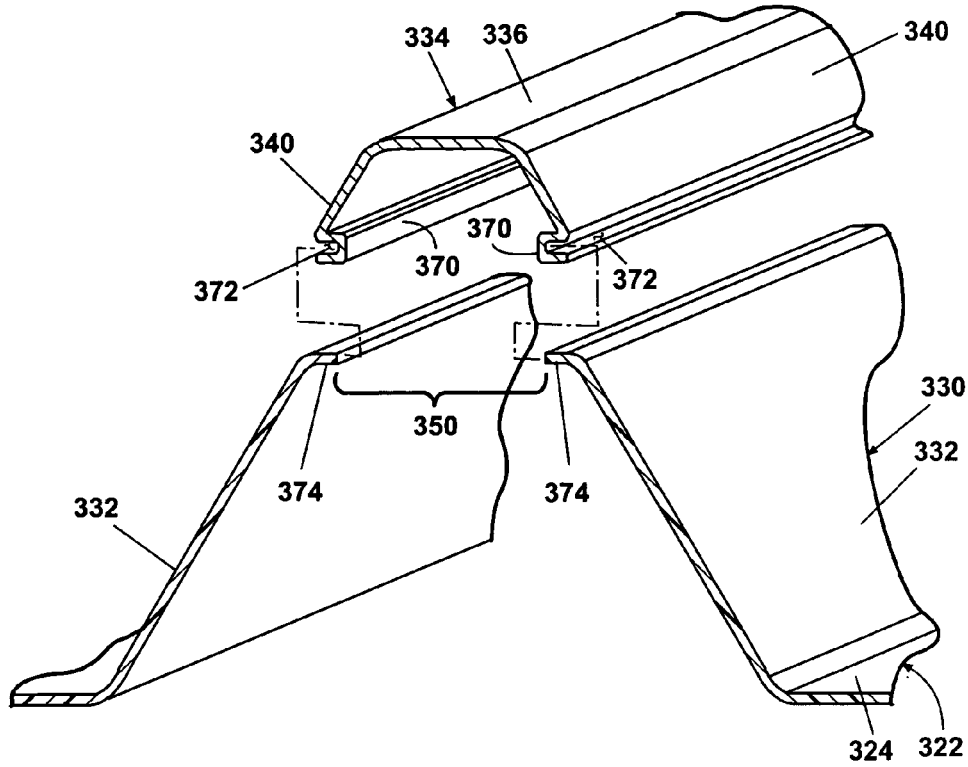
FIG. 18A is a schematic, exploded isometric view of an exemplary blade and tip insert of the impeller of FIG. 14, wherein the tip insert has grooves that slidingly receive projections on the blade.
Figure 18B:
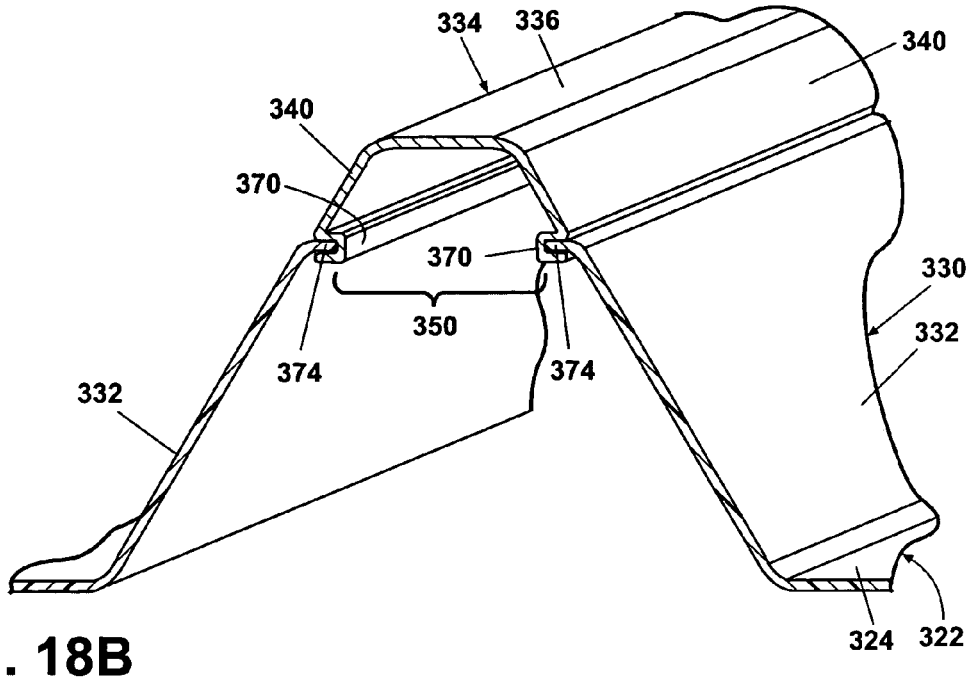
FIG. 18B is a schematic isometric view of FIG. 18A.
Figure 19A:
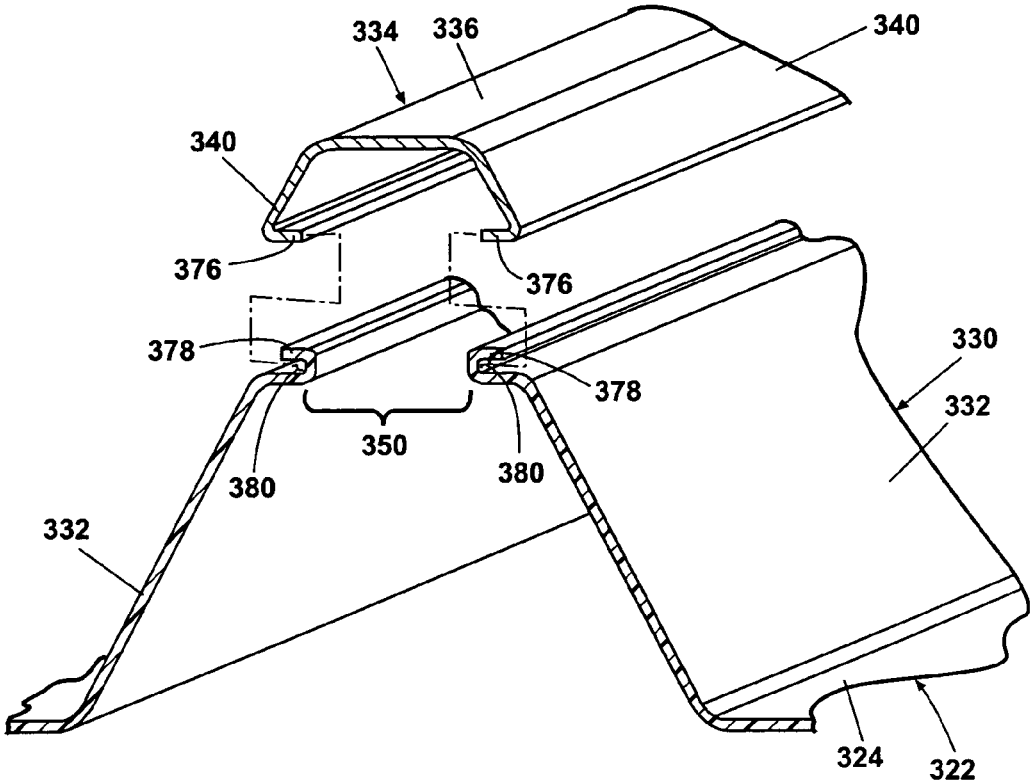
FIG. 19A is a schematic, exploded isometric view of an exemplary blade and tip insert of the impeller of FIG. 14, wherein the blade has grooves that slidingly receive projections on the tip insert.
Figure 19B:
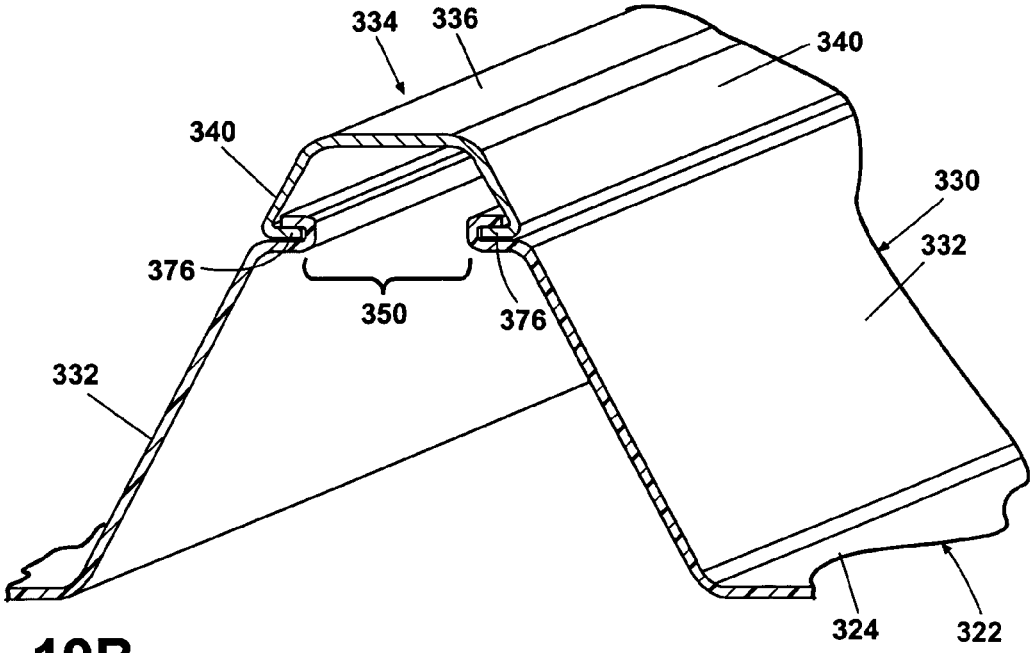
FIG. 19B is a schematic isometric view of FIG. 19A.

Depending on the shape of the tip, the tip insert can be slidably mounted to the blade 330. Preferably, the tip insert and the blade 330 comprise mating projections and grooves, wherein the projections are slidably received by the grooves. Examples of such structures are schematically shown in FIGS. 18A-19B. In FIGS. 18A and 18B, the tip insert comprises a pair of elongated and inward C-shaped flanges 370 that extend along the edges of the opposing side walls 340 and form outwardly facing grooves 372. The edges of the blade 330 along the opening 350 function as elongated projections 374 sized for receipt within the grooves 372. The tip insert of FIGS. 19A and 19B comprises a pair of inward, opposing projections 376 along the edges of the side walls 340, and the blade 330 has a pair of upward L-shaped flanges 378 that extend along the edges of the opening 350 and form outwardly facing grooves 380. To mount the tip inserts of FIGS. 18A-19B to the corresponding blade 330, the projections 374, 376 are aligned with the grooves 372, 380, respectively, and the tip insert is slid onto to the blade 330.

The structures of FIGS. 18A-19B can also be utilized to snap fit the tip insert to the blade 330 if the second material is a resilient material or a sufficiently elastic material. For example, the opposing side walls 340 of the tip insert in FIGS. 18A and 18B can be deflected toward one another so that the flanges 370, when positioned directly over the opening 350, can fit through the opening 350 to align the grooves 372 with the projections 374. Once the tip insert is aligned properly, the opposing side walls 340 are released so that they return to their original orientation while the projections 374 enter the grooves 372.

Figure 20A:
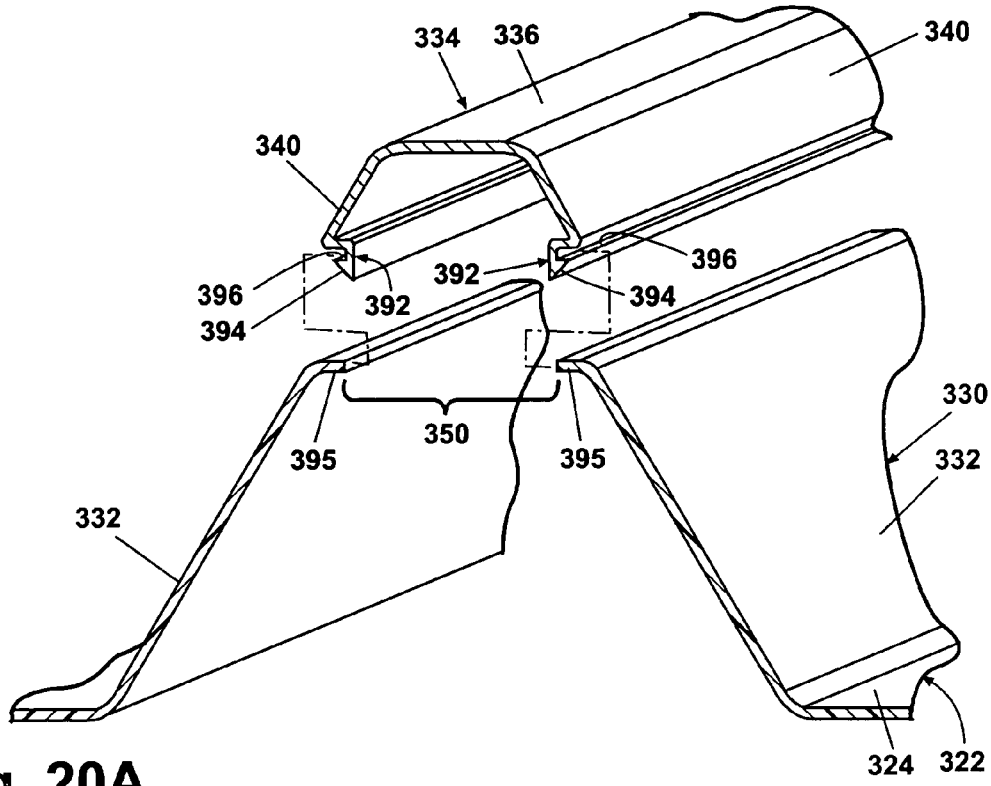
FIG. 20A is a schematic, exploded isometric view of an exemplary blade and tip insert of the impeller of FIG. 14, wherein the tip insert has a pair of opposing, elongated prongs that snap fit into an opening on the blade.
Figure 20B:
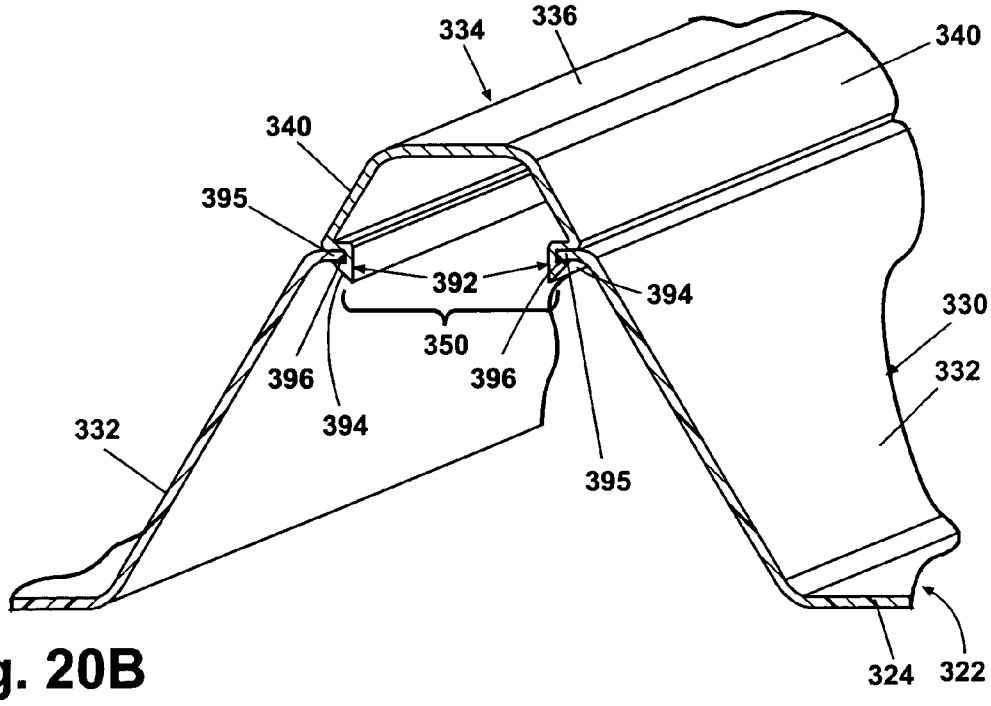
FIG. 20B is a schematic isometric view of FIG. 20A.

Other examples of tip inserts that can be snap fit into the body 322 are schematically shown in FIGS. 20A-22B. Either the tip inserts or the opposing side walls 332 of the blades 330 in these examples comprise resilient prongs that mate with the opening 350 or with other openings formed in either the tip insert or the blade 330. In the example of FIGS. 20A and 20B, a pair of inwardly projecting opposing prongs 392 formed along the edges of the side walls 340 of the tip insert mate with the opening 350, which, in this example, is defined between a pair of inwardly extending flanges 395 of the blade 330. Each of the opposing prongs 392 includes an angled face 394 and a retaining face 396 to facilitate mounting the tip insert to the blade 330. To mount the tip insert to the blade 330, the tip insert is positioned above the blade 330 with the opposing prongs 392 aligned with the opening 350. The opposing side walls 340 are spaced so that the angled faces 394 of the opposing prongs 392 align with the flanges 395. As a result, when the tip insert is lowered into contact with the blade 330, the angled faces 394 ride along the inside edges of the flanges 395 to thereby deflect the opposing prongs 392 inward until the angled faces 394 clear the flanges 395, at which point, the opposing prongs 392 snap outward toward the flanges 395 so that the retaining face 396 abuts the lower surface of flanges 395 to prevent upward movement of the tip insert relative to the blade 330. Alternatively, the opposing prongs 392 can be in the form of a plurality of spaced opposing prongs along the edges of the opposing side walls 340. Additionally, the flanges 395 can alternatively include one or more openings corresponding to the quantity of opposed prongs on the tip insert, and the opposed prongs can be inserted into the openings in the flanges 395.

Figure 21A:
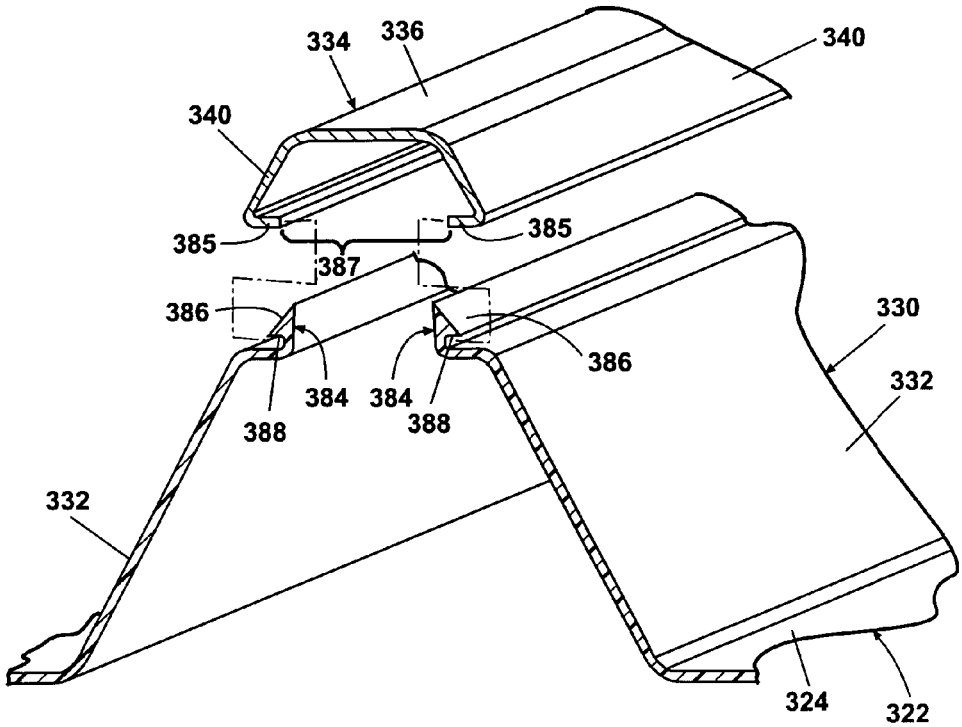
FIG. 21A is a schematic, exploded isometric view of an exemplary blade and tip insert of the impeller of FIG. 14, wherein the blade has a pair of opposing, elongated prongs that snap fit into an opening on the tip insert.
Figure 21B:
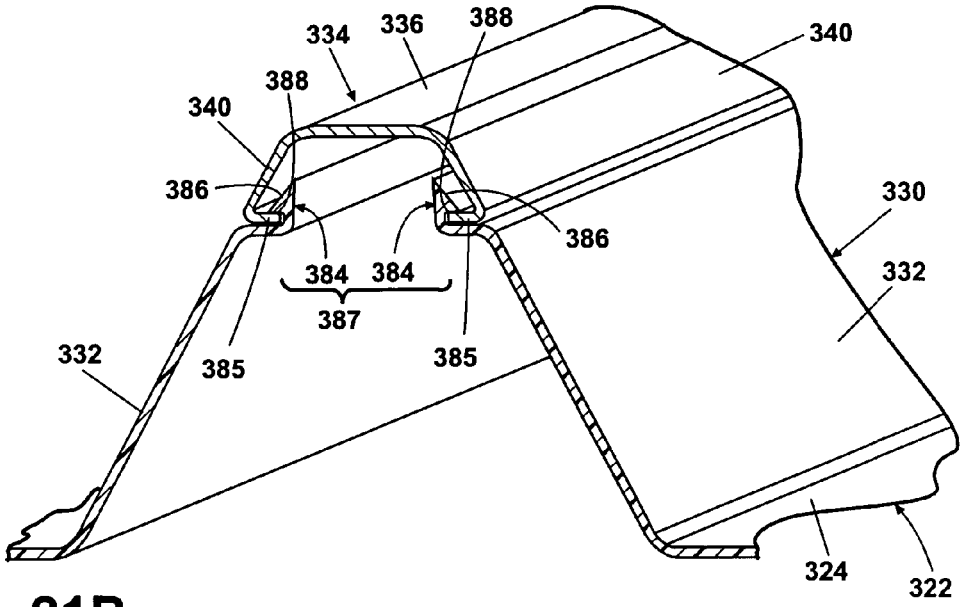
FIG. 21B is a schematic isometric view of FIG. 21A.
Figure 22A:
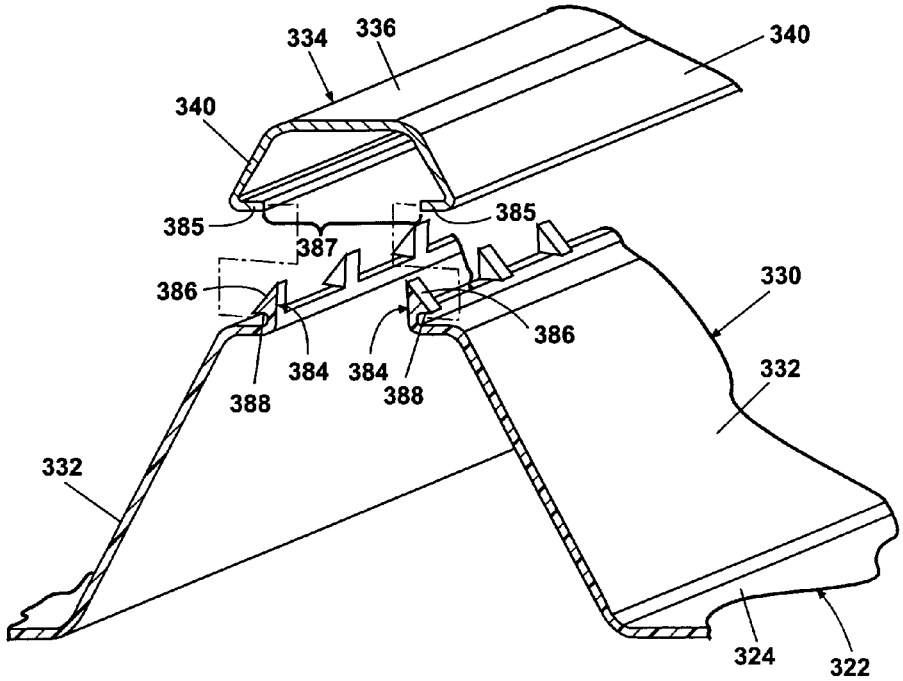
FIG. 22A is a schematic, exploded isometric view of an exemplary blade and tip insert of the impeller of FIG. 14, wherein the blade has a plurality of opposing prongs that snap fit into an opening on the tip insert.
Figure 22B:
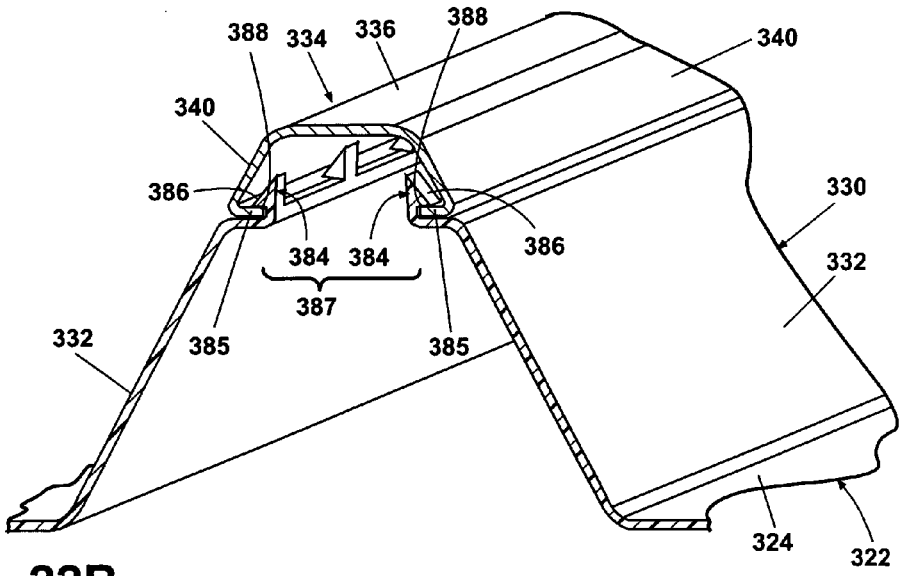
FIG. 22B is a schematic isometric view of FIG. 22A.

In FIGS. 21A and 21B, the blade 330 comprises a pair of inwardly projecting opposing prongs 384 extending along the upper edges of the opposing side walls 332. Each of the opposing prongs 384 includes an angled face 386 and a retaining face 388 to facilitate mounting the tip insert to the blade 330. The tip insert comprises a pair of opposing inward flanges 385 along the edges of the side walls 340 to define an opening 387. To mount the tip insert to the blade 330, the tip insert is positioned above the blade 330 with the flanges 385 aligned with the opposing prongs 384. The side walls 340 are spaced so that the angled faces 386 of the opposing prongs 384 align with the flanges 385. As a result, when the tip insert is lowered into contact with the blade 330, the angled faces 386 ride along the edges of the flanges 385 to thereby flex the opposing prongs 384 inward until the flanges 385 clear the angled faces 386, at which point, the opposing prongs 384 snap outward toward the side walls 340 so that the retaining face 388 abuts the upper surface of the flanges 385 to prevent upward movement of the tip insert relative to the blade 330. Alternatively, the opposing prongs 384 can be in the form of a plurality of opposing prongs, as illustrated in FIGS. 22A and 22B.

According to the invention, the insert, which can form the entire blade, a portion of the blade, or only the tip of the blade, can be used with any clothes washer wash plate having blades for imparting mechanical energy to the fabric load. Examples of wash plates include, but are not limited to, impellers, nutators, and agitators, which can be used alone or in conjunction with an auger. Some of these wash plates are also referred to as pulsators. As used herein, the term "blade" refers to any projection or protuberance of any size and shape on a base or body of the wash plate. In the clothes washer art, the blades have several names, such as vanes, ribs, and fins. Examples of alternative wash plates having blades formed at least in part by an insert are shown in FIGS. 23 and 24.

Figure 23:
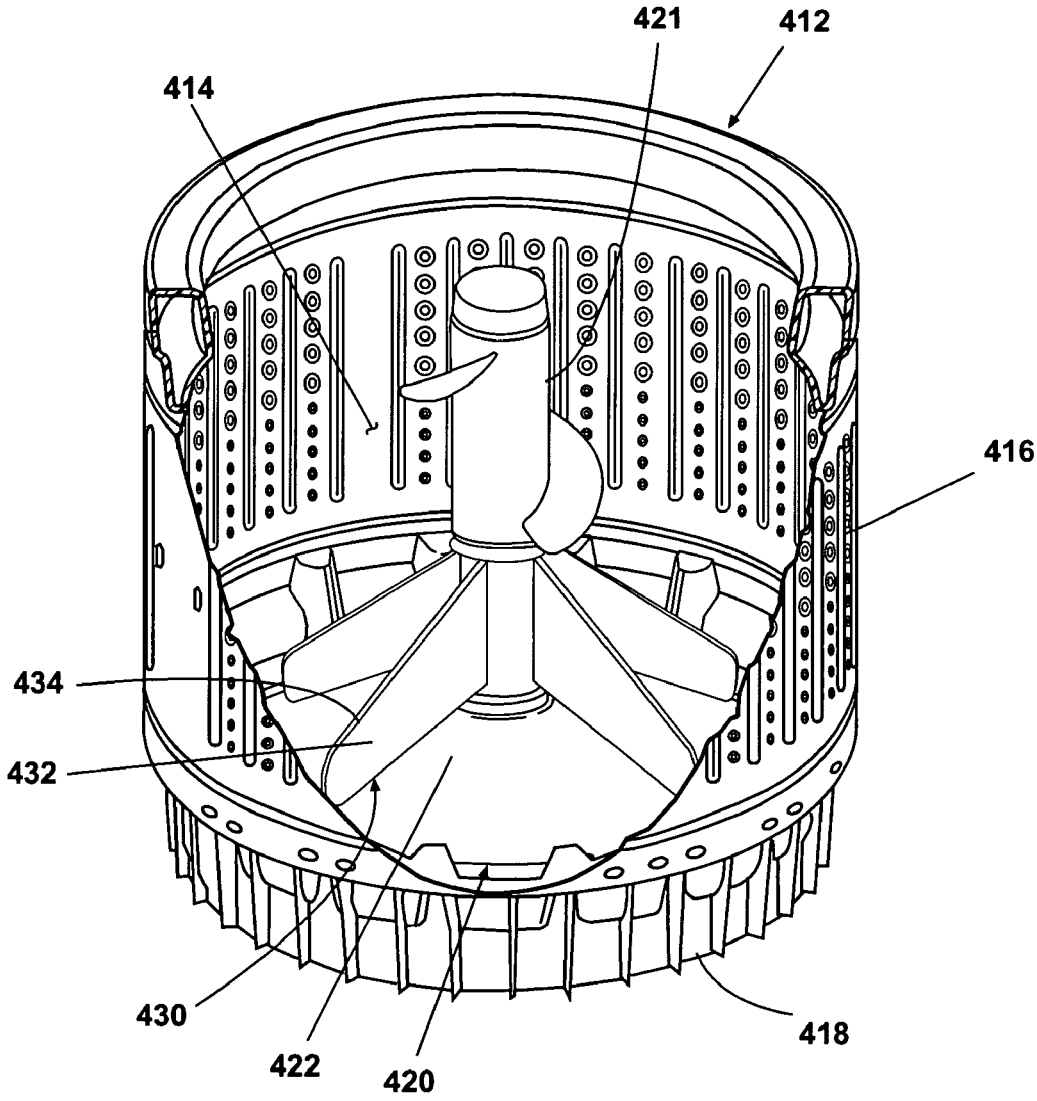
FIG. 23 is a perspective view of a wash basket of a vertical axis automatic clothes washer and an agitator assembly comprising an auger and an agitator having a base and blades formed by an insert according to the invention.

An agitator assembly comprising an agitator 420 and an auger 421 positioned inside a wash basket 412 is illustrated in FIG. 23. The agitator 420 includes a base 422 and several radial blades 430 having opposing side walls 432 and a tip 434, and the entire blade 430 is formed by an insert according to the invention. Alternatively, the insert can form only a portion of the blade 430 or only the tip 434. The insert can be mounted to the agitator 420 in any suitable manner, such as those described previously for the impellers 20 and 320.

Figure 24:
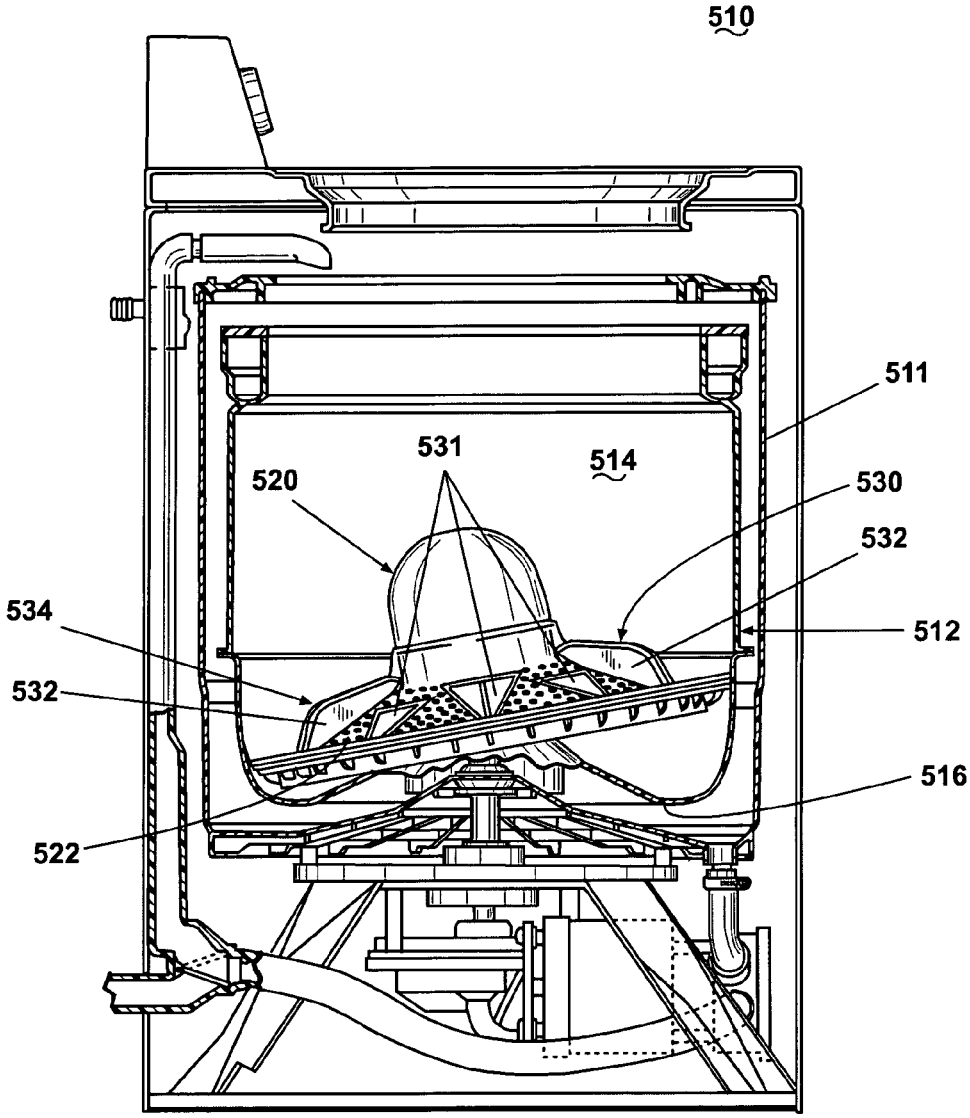
FIG. 24 is a perspective view of a wash basket of a vertical axis automatic clothes washer and a nutator having a base and blades with a tip formed by a tip insert according to the invention.

A wash plate in the form of a nutator 520 mounted inside a wash basket 512 that is housed within a wash tub 511 is illustrated in FIG. 24. The nutator 520 comprises a base 522 and multiple blades 530 having opposing side walls 532 and a tip 534, wherein the tip 534 is formed by an insert according to the invention. Alternatively, the insert can form a portion of the blade 530 or the entire blade 530. Additionally, the nutator 520 includes several protrusions 531 that can also be formed, at least in part, by an insert. The insert can be mounted to the nutator 520 in any suitable manner, such as those described previously for the impellers 20 and 320.

Figure 25:
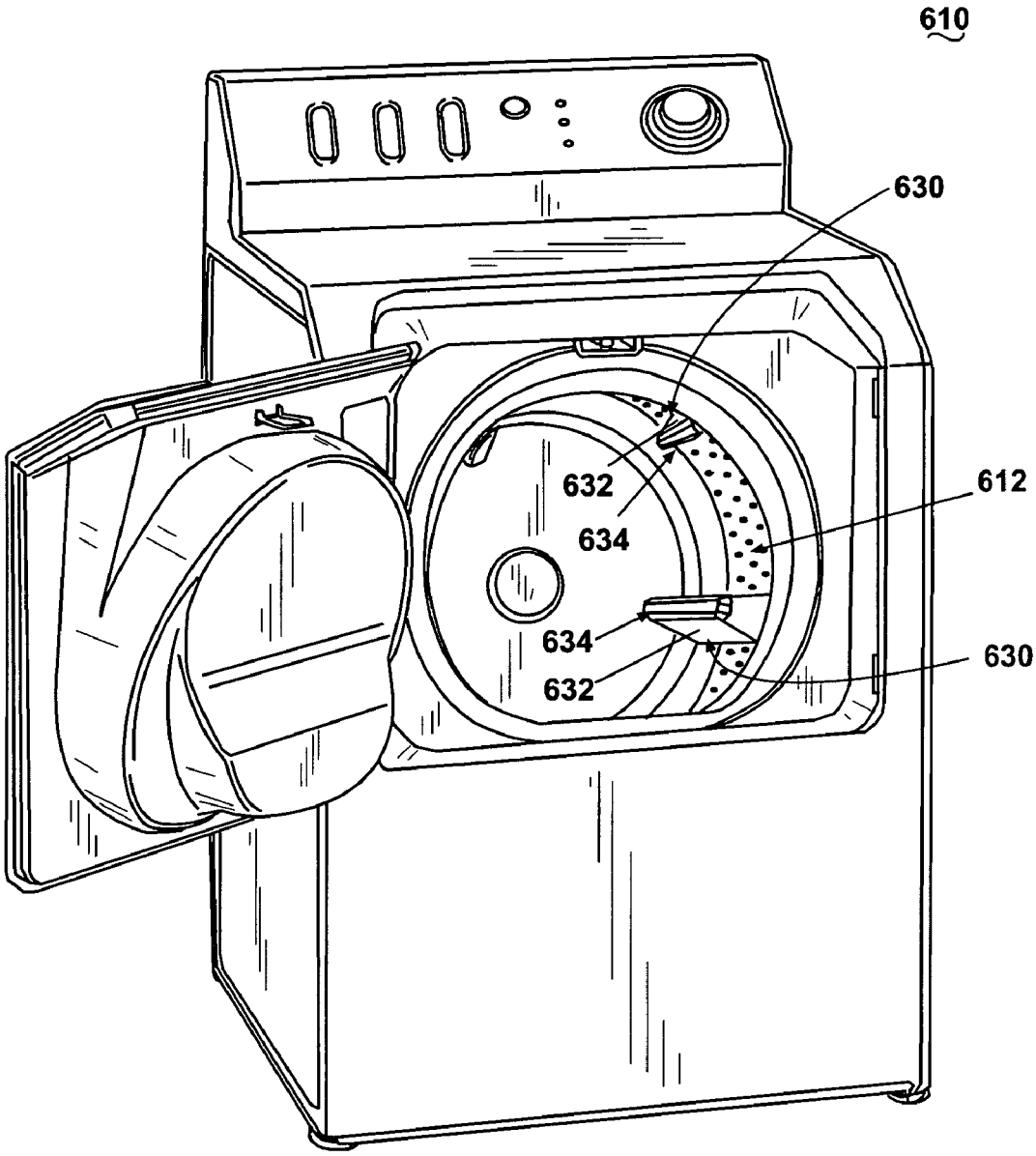
FIG. 25 is a perspective view of a horizontal axis automatic clothes washer comprising a wash basket with blades having tips formed by a tip insert according to the invention.

In addition to vertical axis clothes washers, the insert can be utilized with horizontal axis clothes washers and clothes dryers. For example, FIG. 25 illustrates a horizontal axis clothes washer 610 comprising a wash basket 612 with a plurality of circumferentially spaced, inwardly extending blades 630 that are parallel to a longitudinal axis of the wash basket 612. The blades 630 have opposing side walls 632 that join at a tip 634, and the tip 634 is formed by an insert according to the invention. Alternatively, the insert can form a portion of the blade 630 or the entire blade 630.

Figure 26:
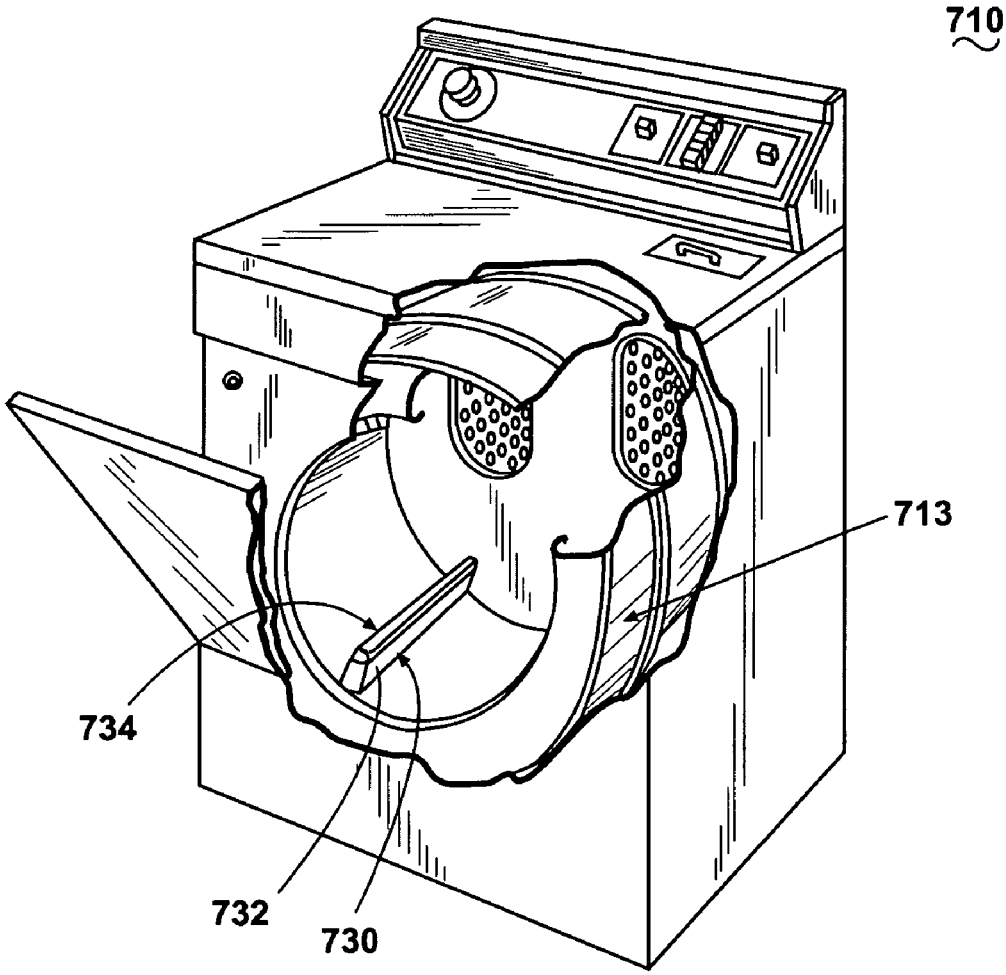
FIG. 26 is a perspective view of an automatic clothes dryer comprising a drum with blades having tips formed by a tip insert according to the invention.

The technology of the invention is applicable to clothes dryers, which have some similarities to a horizontal axis washer. A clothes dryer 710 illustrated in FIG. 26 comprises an imperforate, generally cylindrical drying drum 713 with a plurality of circumferentially spaced, inwardly extending blades 730 that are parallel to a longitudinal axis of the drying drum 713, much like the blades 630 in the horizontal axis clothes washer 610. The blades 730 have opposing side walls 732 that join at a tip 734, and the tip 734 is formed by an insert according to the invention. Alternatively, the insert can form a portion of the blade 730 or the entire blade 730. The blades of the dryer drum can be improved by making them in any of the ways described for the washing plate.

As described and shown above in several embodiments of the invention, the wear resistance and, therefore, performance and life of a variety of wash plates and other clothes washing and drying appliance components are improved by forming at least a portion of a blade thereof by an insert made of a relatively hard and wear resistant material. Furthermore, the cost of the wash plate with an insert according to the invention is significantly less than the cost of a wash plate made entirely of the relatively hard and wear resistant material, especially when this material is stainless steel. Additional benefits attributed the insert are an improved appearance of the wash plate and increased versatility. For example, if the insert is removable, the user or a service professional can easily replace the insert to alter the appearance of the wash plate or to service the wash plate.

While the invention has been specifically described in connection with certain specific embodiments thereof, it is to be understood that this is by way of illustration and not of limitation, and the scope of the appended claims should be construed as broadly as the prior art will permit.

What is claimed is:

1. An automatic clothes washer for washing articles of fabric, comprising:

a wash tub defining a wash chamber for receiving the articles of fabric; and a wash plate movably mounted within the wash tub for imparting mechanical energy to the articles of fabric, the wash plate comprising a blade the blade made from a first material and terminating in a tip made from a second material having a hardness greater than the first material wherein both the blade first material and the blade second material are exposed to direct contact with the articles of fabric during use of the washer.

2. The automatic clothes washer according to claim 1, wherein the second material is metal.

3. The automatic clothes washer according to claim 1, wherein the tip is formed by a replaceable insert.

4. The automatic clothes washer according to claim 3, wherein the insert is snap fit onto the blade.

5. The automatic clothes washer according to claim 3, wherein the insert is slidably mounted to the blade.

6. The automatic clothes washer according to claim 1, wherein the wash plate comprises a central portion and a peripheral edge, and the blade extends radially outwardly from the central portion to the peripheral edge.

7. The automatic clothes washer according to claim 1, wherein the fist material a is a different color than the second material.

8. The automatic clothes washer according to claim 1, wherein the wash plate is one of an agitator, an impeller, and a nutator.

9. An automatic clothes washer for washing articles of fabric, comprising:

a wash tub defining a wash chamber for receiving the articles of fabric; and a wash plate movably mounted within the wash tub for imparting mechanical energy to the articles of fabric, the wash plate made from plastic and having a blade, the blade having a plastic portion and terminating in a replaceable tip made from metal, wherein both the blade plastic portion and the blade metal tip are exposed to direct contact with the particles of fabric during use of the washer.

10. The automatic clothes washer according to claim 9, wherein the wash plate comprises a central portion and a peripheral edge, and the blade extends radially outwardly from the central portion to the peripheral edge.

11. An automatic clothes washer for washing articles of fabric, comprising:

a wash tub defining a wash chamber for receiving the articles of fabric; and a wash plate movably mounted within the wash tub for imparting mechanical energy to the articles of fabric, the wash plate made from a first material and comprising a blade and a replaceable insert forming only a tip part of the blade, the blade having a proportion made from the first material, and the insert being made from a second material having a hardness greater than the first material, wherein both the blade first material portion and the blade tip part are exposed to direct contact with the articles of fabric during use of the washer.

12. The automatic clothes washer according to claim 11, wherein the insert forms a tip of the blade.

13. The automatic clothes washer according to claim 11, wherein the insert is made of metal.

14. The automatic clothes washer according to claim 11, wherein the wash plate further comprises a base and the insert is snap fit onto one of the base and the blade.

15. The automatic clothes washer according to claim 11, wherein the wash plate further comprises a base and the insert is slidably mounted to one of the base and the blade.

16. The automatic clothes washer according to claim 11, wherein the first material is a different color than the second material.

17. The automatic clothes washer according to claim 11, wherein the wash plate is one of an agitator, an impeller, and a nutator.

* * * * *